US006543667B2

(12) United States Patent
Yoshie et al.

(10) Patent No.: US 6,543,667 B2
(45) Date of Patent: Apr. 8, 2003

(54) CARTRIDGE FOR A MOTOR-OPERATED STAPLER

(75) Inventors: Toru Yoshie, Tokyo (JP); Toshio Shimizu, Tokyo (JP)

(73) Assignee: MAX Co., Ltd., Tokyo (JP)

( * ) Notice: Subject to any disclaimer, the term of this patent is extended or adjusted under 35 U.S.C. 154(b) by 0 days.

(21) Appl. No.: 09/751,204

(22) Filed: Dec. 29, 2000

(65) Prior Publication Data

US 2001/0004988 A1 Jun. 28, 2001

(30) Foreign Application Priority Data

Dec. 28, 1999 (JP) ..... 11-375264
Dec. 28, 1999 (JP) ..... 11-375265
Sep. 8, 2000 (JP) ..... 2000-273234

(51) Int. Cl.[7] ..... B25C 5/16

(52) U.S. Cl. ..... 227/120; 227/131; 227/136; 206/338

(58) Field of Search ..... 227/120, 136, 227/131, 155; 206/338

(56) References Cited

U.S. PATENT DOCUMENTS 4,570,841 A * 2/1986 Olesen ..... 227/131
4,623,082 A * 11/1986 Kurosawa ..... 227/120
4,993,616 A * 2/1991 Yoshie et al. ..... 227/120
5,560,529 A * 10/1996 Udagawa et al. ..... 227/136
5,836,502 A * 11/1998 Kanai et al. ..... 227/131
6,039,230 A * 3/2000 Yagi et al. ..... 227/131

* cited by examiner

*Primary Examiner*—Scott A. Smith
(74) *Attorney, Agent, or Firm*—Chapman and Cutler

(57) ABSTRACT

A cartridge body 602 is formed with a receptacle chamber 603 for accommodating sheet staples ST therein in a stacked state and is also formed with a drive-out passage 601 for driving out the sheet staples ST, and within the cartridge body 602 is provided a plate spring 520 for pressing the sheet staples ST stacked in the receptacle chamber 603 toward the drive-out passage 601.

7 Claims, 39 Drawing Sheets

CARTRIDGE FOR A MOTOR-OPERATED STAPLER

BACKGROUND OF THE INVENTION

1. Title of the Invention

The present invention relates to a cartridge for a motor-operated stapler wherein sheet staples are accommodated in a stacked state.

2. Description of the Prior Art

Heretofore there has been known such a cartridge for a motor-operated stapler as shown in FIG. 39.

In this conventional motor-operated stapler, indicated at A, is provided with a cartridge body B for accommodating sheet staples S in a stacked state, a delivery section D provided at an upper end of a side wall of the cartridge body and formed with a feed passage C for sending out the stacked sheet staples S, and a drive-out section E provided at a front end of the delivery section D. A driver (not shown) adapted to reciprocate advances into the drive-out section E, whereby a staple from the sheet staples S, which staple has been formed in U-shape, is driven out from the drive-out section E.

Within the cartridge body B are disposed a vertically movable holder F, a spring G which urges the holder F upward, and a pair of retain pieces I extending upward from the bottom and formed with pawls TH respectively. The holder F holds the stacked sheet staples S.

In the cartridge A constructed as above, even if the spring G is compressed, the compressed spring G has a predetermined height. Therefore, it is necessary that a space for accommodating the spring G therein be ensured over a certain area or more within the cartridge body. In the case where the cartridge A is reduced in size, the proportion of the space for accommodating the spring G becomes large and the space for stacking sheet staples becomes so much narrower, thus giving rise to the problem that the number of sheet staples capable of being stacked within the cartridge body becomes smaller.

SUMMARY OF THE INVENTION

It is an object of the present invention to provide a cartridge for a motor-operated stapler capable of of stacking a large number of sheet staples even if the cartridge is reduced in size.

According to the present invention, for achieving the above-mentioned object, there is provided a cartridge for a motor-operated stapler, comprising a cartridge body formed with a receptacle chamber for accommodating sheet staple in a stacked state and also armed with a delivery hole for sending out the sheet staples from the receptacle chamber, and a pushing means or pushing the sheet staples accommodated in the receptacle chamber toward the delivery hole within the cartridge body, the pushing means being constituted by a plate spring

BRIEF DESCRIPTION OF THE DRAWINGS

FIG. 35 is an explanatory diagram showing an unlocked state of the

DETAILED DESCRIPTION OF THE EMBODIMENTS

Cartridges embodying the present invention, as well as motor-operated staplers with the cartridges loaded therein or operation, will be described hereunder with reference to the accompanying drawings.

Embodiment

Figure 1B:
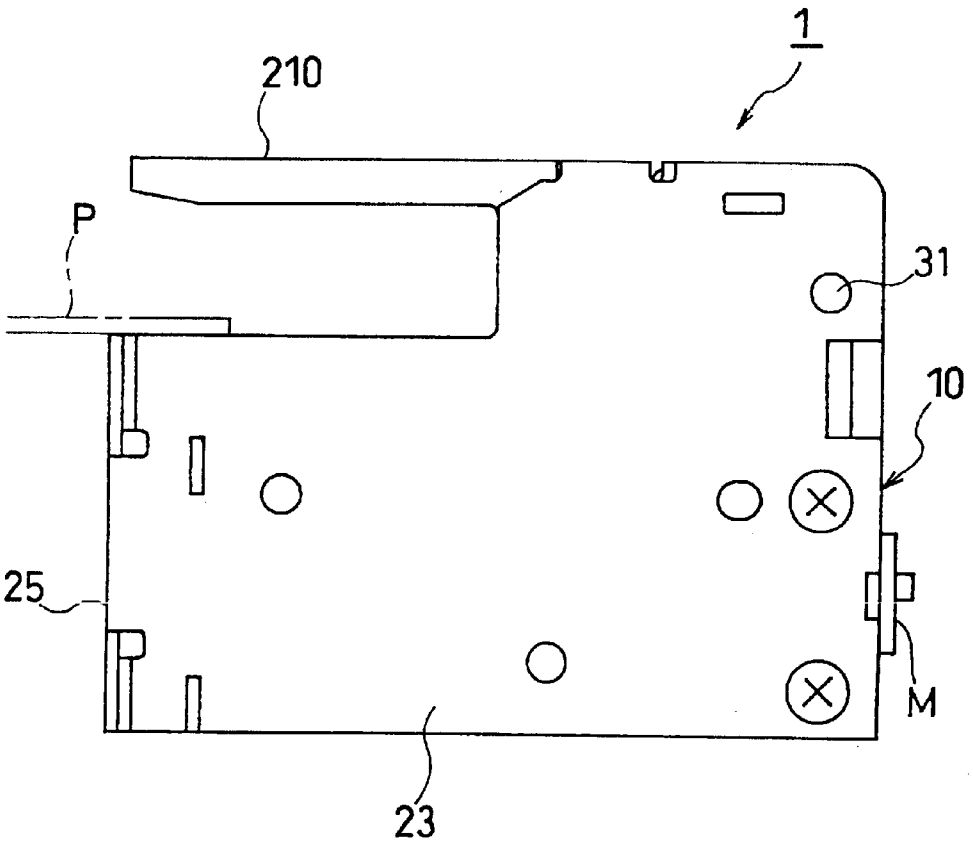
FIG. 1(B) is a side view of the motor-operated stapler.
Figure 1A:
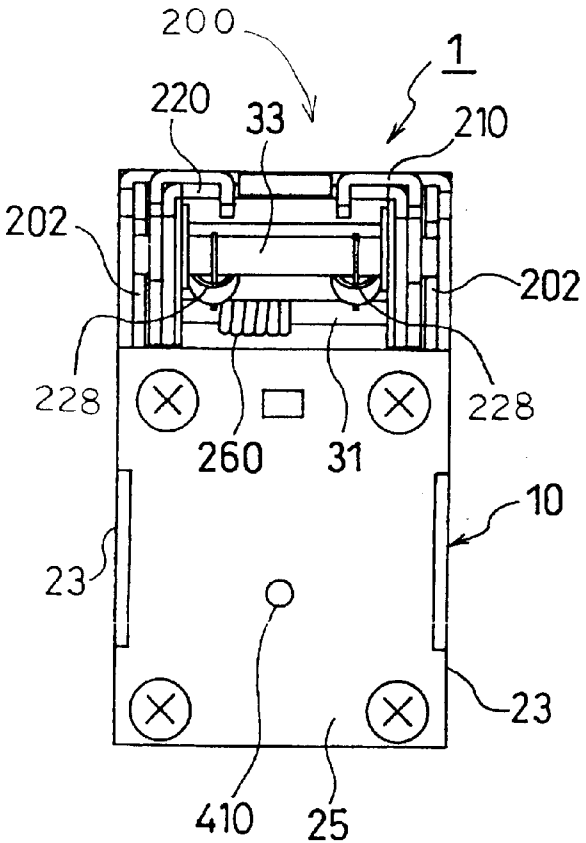
FIG. 1(A) is a front view showing an appearance of a motor-operated stapler according to a fist embodiment of the present invention.
Figure 2A:
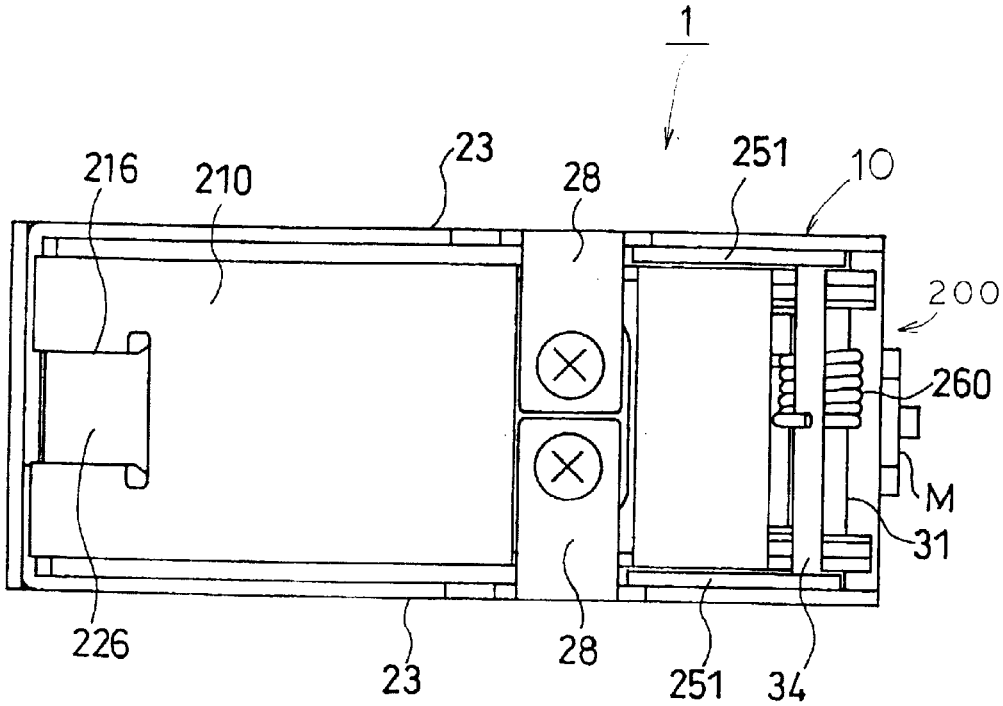
FIG. 2(A) is a plan view of the motor operated stapler shown in FIG. 1.
Figure 2B:
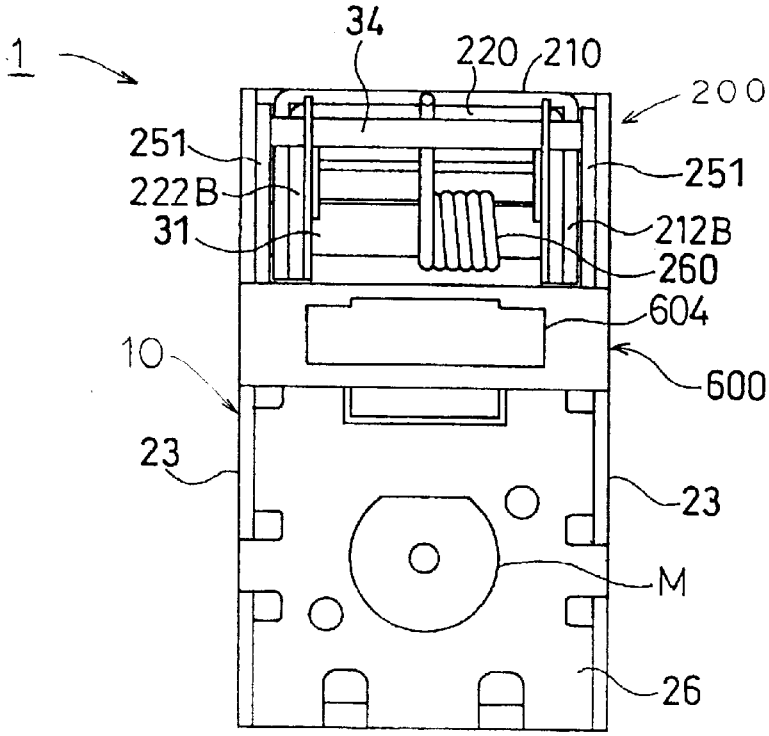
FIG. 2(B) is a rear view of the motor-operated stapler shown in FIG. 1.
Figure 3:
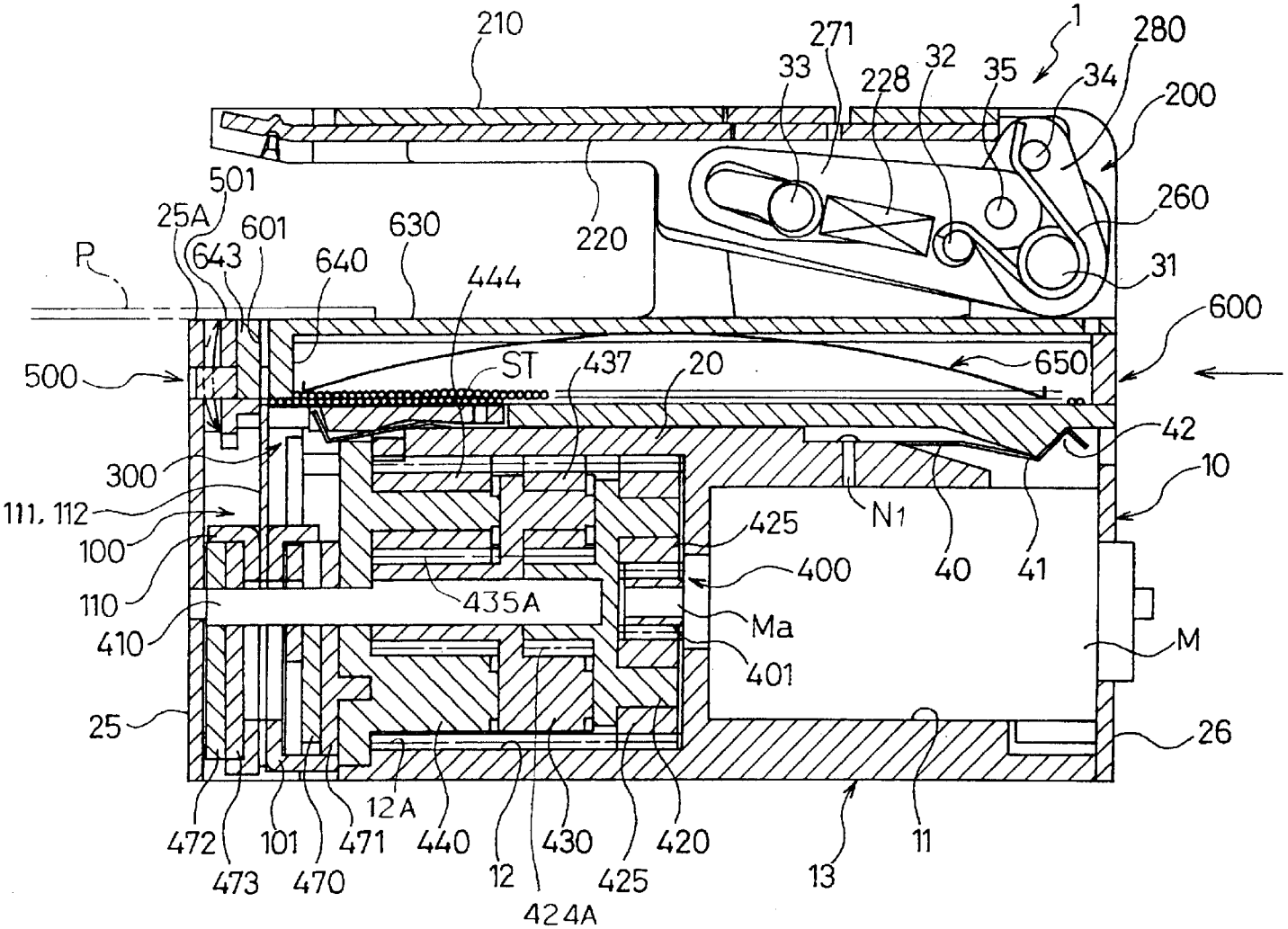
FIG. 3 is a longitudinal sectional view showing a construction of the motor-operated stapler illustrated in FIG. 1.

In FIGS. 1 to 3, the reference numeral 1 denotes a motor-operated stapler to be attached to a copying machine for example. The motor-operated stapler 1 is made up of a stapler body 10 and a cartridge 600 which is loaded into the stapler body 10 removably.

In the stapler body 10 are provided a drive-out mechanism 100 for driving out staples (not shown) from a drive-out passage 601 formed in the cartridge 600, a clincher mechanism 200 for clinching end portions of each staple which is driven out, a delivery mechanism 300 for sending out sheet staples ST stacked within the cartridge 600 to one end of the drive-out passage 601, a drive mechanism 400 for driving the mechanisms 100, 200 and 300, and an anvil mechanism 600 for withdrawing an anvil to be described later from the drive-out passage 601 after U-shape arming of the driven-out staple.

Figure 4:
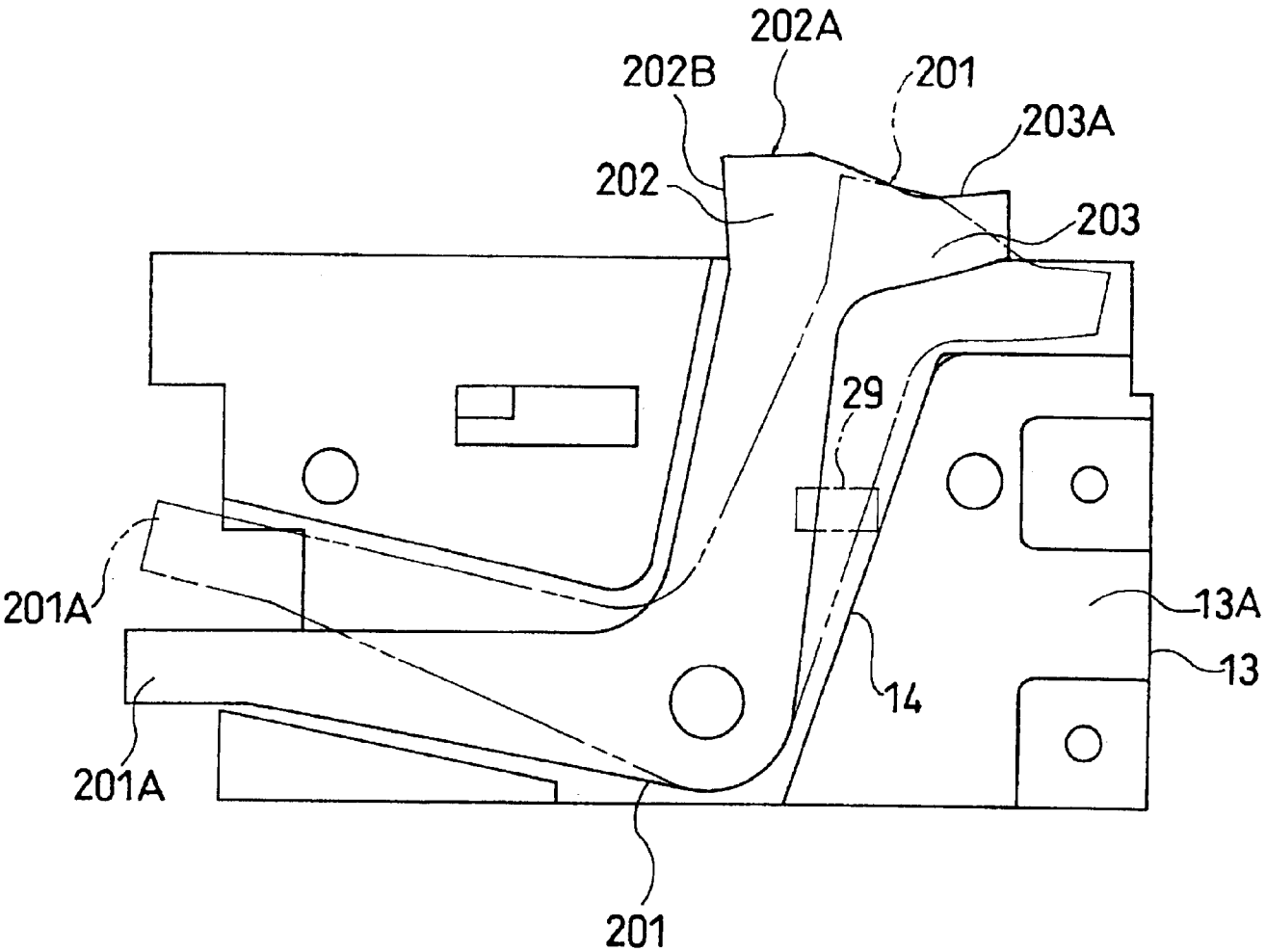
FIG. 4 is an explanatory diagram showing a mounted state of a clincher link.

As shown in FIG. 3, the stapler body 10 is provided with a body case 13 having a motor chamber 11 and a gear chamber 12 both of a generally circular shape. Inside the gear chamber 12 are formed internal teeth 12A and on both side faces 13A of the body case 13 are formed L-shaped grooves 14 as in FIG. 4. Clincher links 201 are respectively fitted in the grooves 14 so as to be pivotable up to a chain line position thereof.

Side plates 23 an attached respectively to both side faces 13A of the body case 13 and a front plate 25 and a rear plate 26 are attached respectively to front and rear sides of the body case 13. A microswitch 29 is attached to one side plate 23 to detect the clincher links 201 when located at a solid line position thereof (see FIG. 4). With the clincher links 201 located at the solid line position, a forming holder 110 to be described later assumes a home position thereof (the position shown in FIG. 3).

As shown in FIG. 3, a fixing spring 40 is secured with screw N1 to a rear side of a ceiling wall 20 of the body case 13. The fixing spring 40 has a valley portion 41 formed in a generally V shape and a crest portion 42 formed in an inverted V shape behind the valley portion 41.

[Drive Mechanism]

As shown in FIG. 3, the drive mechanism 400 has a driving gear 401 mounted on a motor shaft Ma of a motor M, a first mid-gear holder 420 mounted on a drive shaft 410, a second mid-gear holder 430 mounted on the drive shaft 410, a driving gear holder 440, a driver cam 470, a driver return cam 471, a forming cam 472, and a forming return cam 473. The driving gear holder 440 and the cams 470–473 are mounted on a D-cut portion of the drive s 410 so as to rotate together with the driving shaft 410, The motor M is disposed below the cartridge 600 so that the motor shaft Ma of the motor M faces in the same direction as the delivery direction of the sheet staples ST in the cartridge 600 which will be described later. Further, the motor shaft Ma and the drive shaft 410 are aligned with each other.

[First Mid-Gear Holder]

A pair of planetary gears 425 are rotatably mounted on the first mid-gear holder 420 and are in mesh with the internal teeth 12A of the gear chamber 12 and also with the driving gear 401.

[Second Mid-Gear Holder]

A planetary gear 437 is rotatably mounted on the second mid-gear holder 430 and is in mesh with the internal teeth 12A of the gear chamber 12 and also with a gear 424A of the first mid-gear holder 420.

[Driving Gear Holder]

A planetary gear 444 is rotatably mounted on the driving gear holder 440 and is in mesh with the internal teeth 12A of the gear chamber 12 and also with a gear 435A of the second mid-gear holder 430.

As the motor shaft Ma of the motor M rotates, the driving gear holder 440 rotates through the planetary gears 425, 437, 444 and further through the first and second mid-gear holders 420, 430. This rotation of the driving gear holder 440 causes rotation of the drive shaft 410. The planetary gears 426, 437, 444, the first and second mid-gear holders 420, 430 and the gears 424A, 434A constitute a reduction gearing. The planetary gears 425, 437, and 444 are disposed around the drive shaft 410.

[Drive-out Mechanism]

Figure 5:
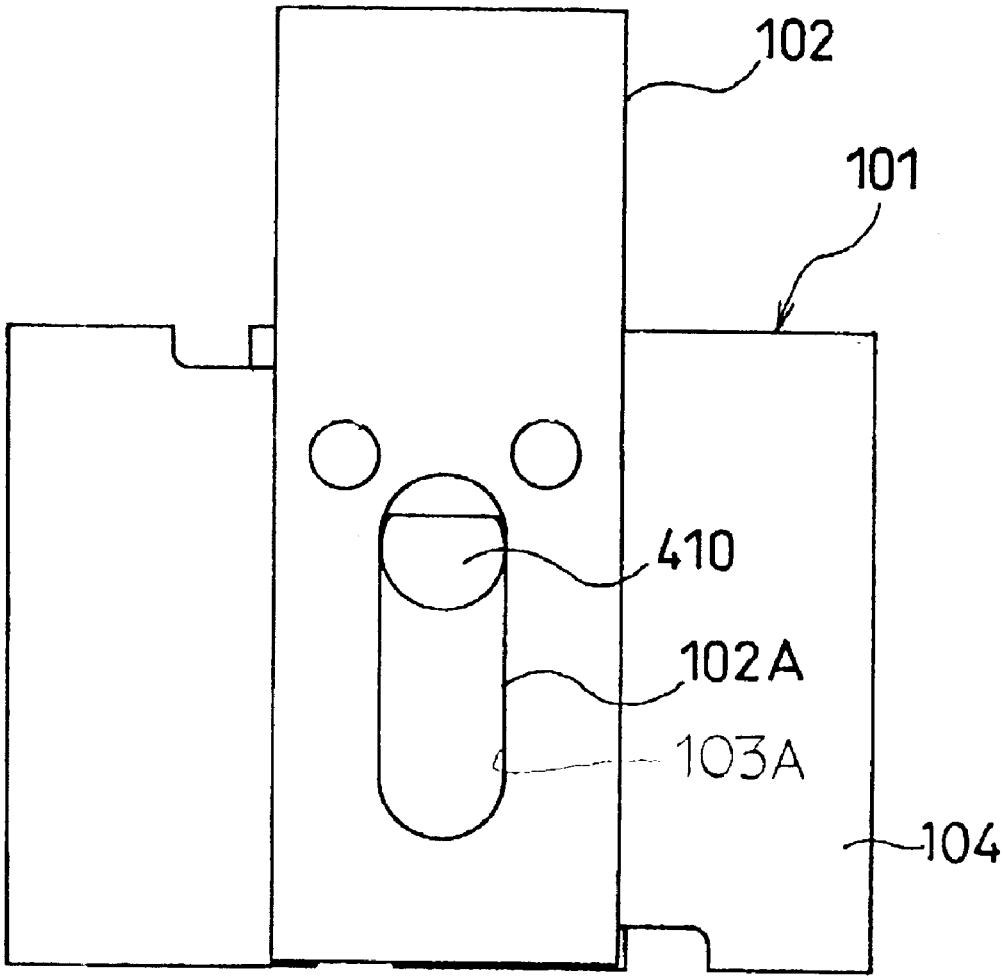
FIG. 5 is an explanatory diagram showing a state in which a driver is mounted to a driver holder.
Figure 6:
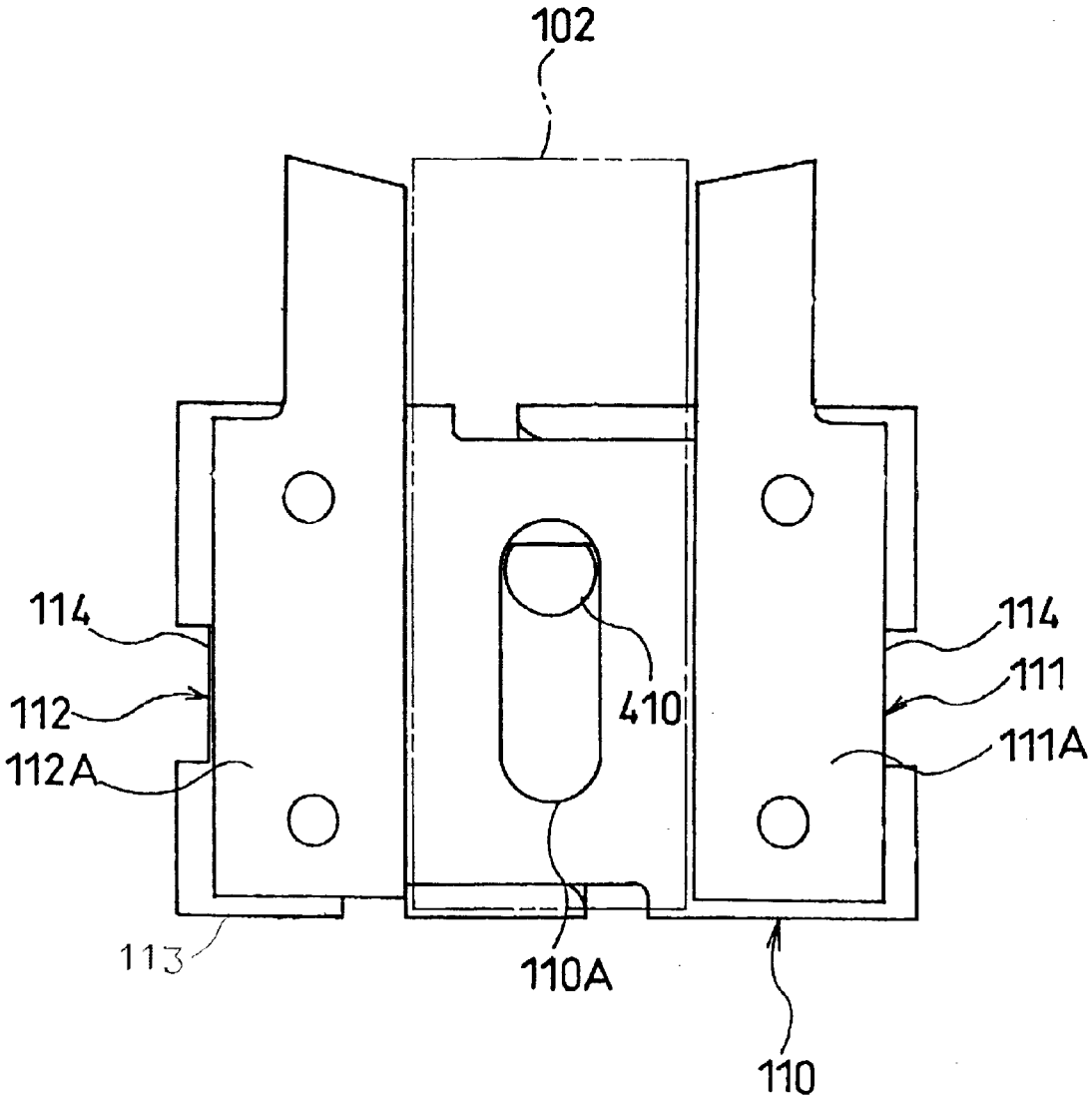
FIG. 6 is an explanatory diagram showing a state in which a forming plate is mounted to a forming holder.

As shown in FIGS. 5 and 6, the drive-out mechanism 100 has a driver holder 101, a driver 102 attached to the driver holder 101, a forming holder 110, and forming plates 111 and 112 attached to the forming holder 110.

The drive shaft 410 is inserted into elongated holes 103A and 102A formed in the driver holder 101 and the driver 102. The elongated holes 103A and 102A permit the driver holder 101 and the driver 102 to move vertically relative to the drive shaft 410.

With rotation of the driver cam 470, the driver holder 101 goes up, while with rotation of the driver return cam 471, the driver holder 101 goes down.

The drive shaft 410 is inserted into an elongated hole 110A formed in the forming holder 110. The elongated hole 110A permits the forming holder 110 to move vertically relative to the drive shaft 410. The forming holder 110 goes up and down with rotation of the forming cam 472 and that of the forming return cam 473, respectively.

sFront end portions 201A of the clincher links 201 are inserted into cutout portions 114 of the forming holder 110. As the forming holder 110 moves up and down, the clincher links 201 reciprocate between the solid line and chain line positions thereof (see FIG. 4).

With an upward movement of the forming holder 110 the forming plates 111 and 112 advance into the drive-out passage 601 and form a staple in U-shape, while with an upward movement of the driver holder 101 the driver 102 advances into the drive-out passage 601 and drives out the U-shaped staple from the drive-out passage 601.

[Anvil Mechanism]

Figure 7:
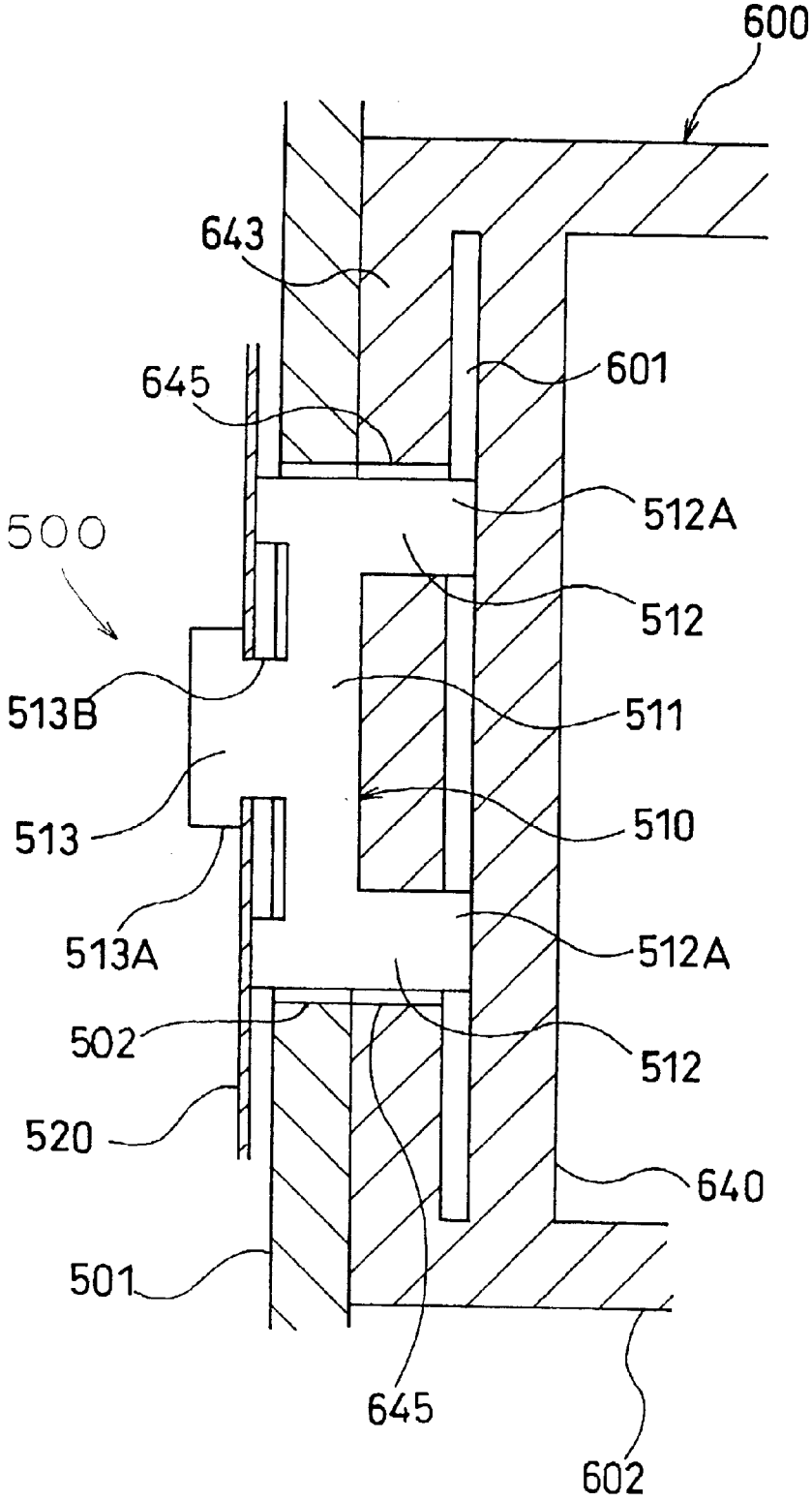
FIG. 7 is a sectional plan view showing a state in which a front end portion of an anvil has entered a drive-out passage armed in a cartridge.
Figure 8:
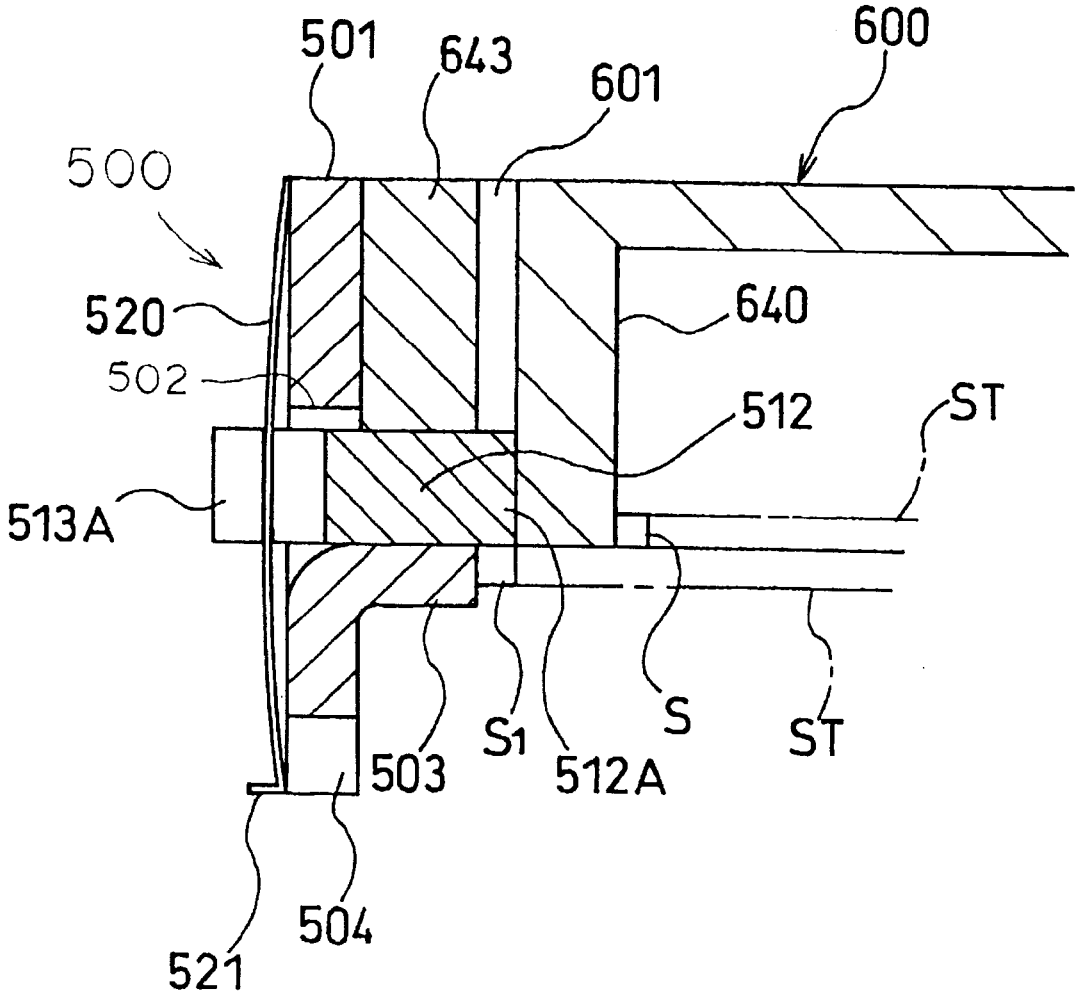
FIG. 8 is a sectional side view showing a state in which the anvil front end portion has entered the cartridge drive-out passage.

As shown in FIGS. 7 and 8, the anvil mechanism 500 is composed of an anvil plate 501, an anvil 510 held by the anvil plate 501, and a plate spring 020 secured to the anvil plate 501.

[Anvil Plate]

The anvil plate 501 is constituted by a rectangular plate portion having a central rectangular opening 502. Below the opening 502 is formed a holding portion 503 extending backward and a recess 504 is formed in a lower end of the anvil plate 501. The anvil plate 501 is fixed to the front plate 25 with screws (not shown).

A plate spring 520 is secured to the front side of the anvil plate 501. A lower portion of the plate spring 520 is formed with a forwardly bent portion 521. An upper portion of the plate spring 520 is fixed to an upper portion of the anvil plate 501. The plate spring 520 is curved in a slightly forwardly projected state.

The anvil 610 is disposed longitudinally movably within the opening 502 of the anvil plate 501 and is placed on the holding portion 503.

[Anvil]

As shown in FIG. 7, the anvil 510 has a base portion 511 extending in the transverse direction, anvil portions 512 extending backward from both ends of the base portion 511, and a projecting portion 513 projecting forward from a central part of the base portion 511. The projecting portion 513 is formed with a head part 513A and a constricted part 513B. The constricted part 513B extends through the plate spring 520 and the head part 513A is projected to the front side of the plate spring 520. Through the head part 513A the anvil 510 is fixed to the plate spring 520.

Figure 21:
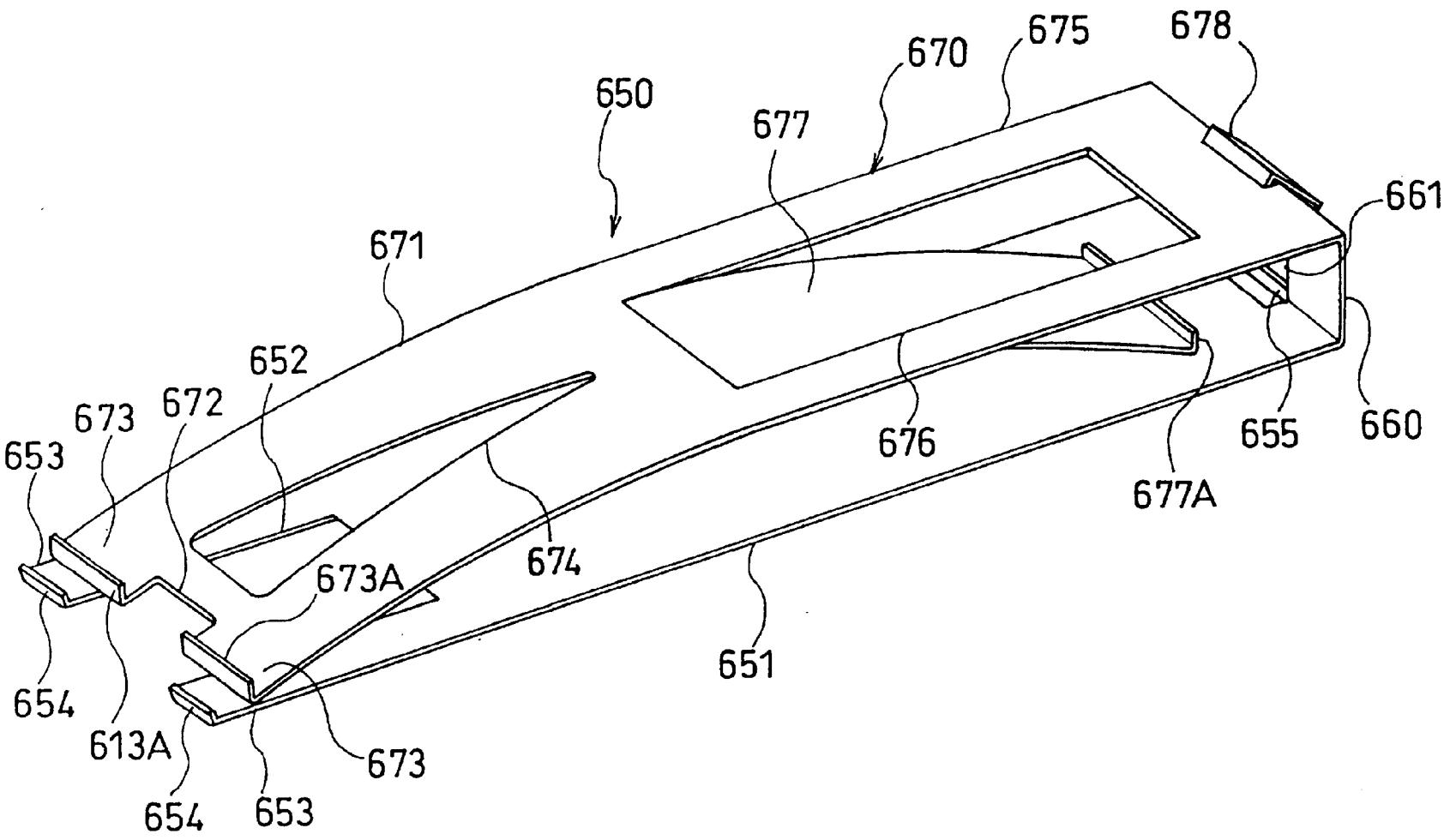
FIG. 21 is a perspective view showing a plate spring member disposed in the cartridge.
Figure 27:
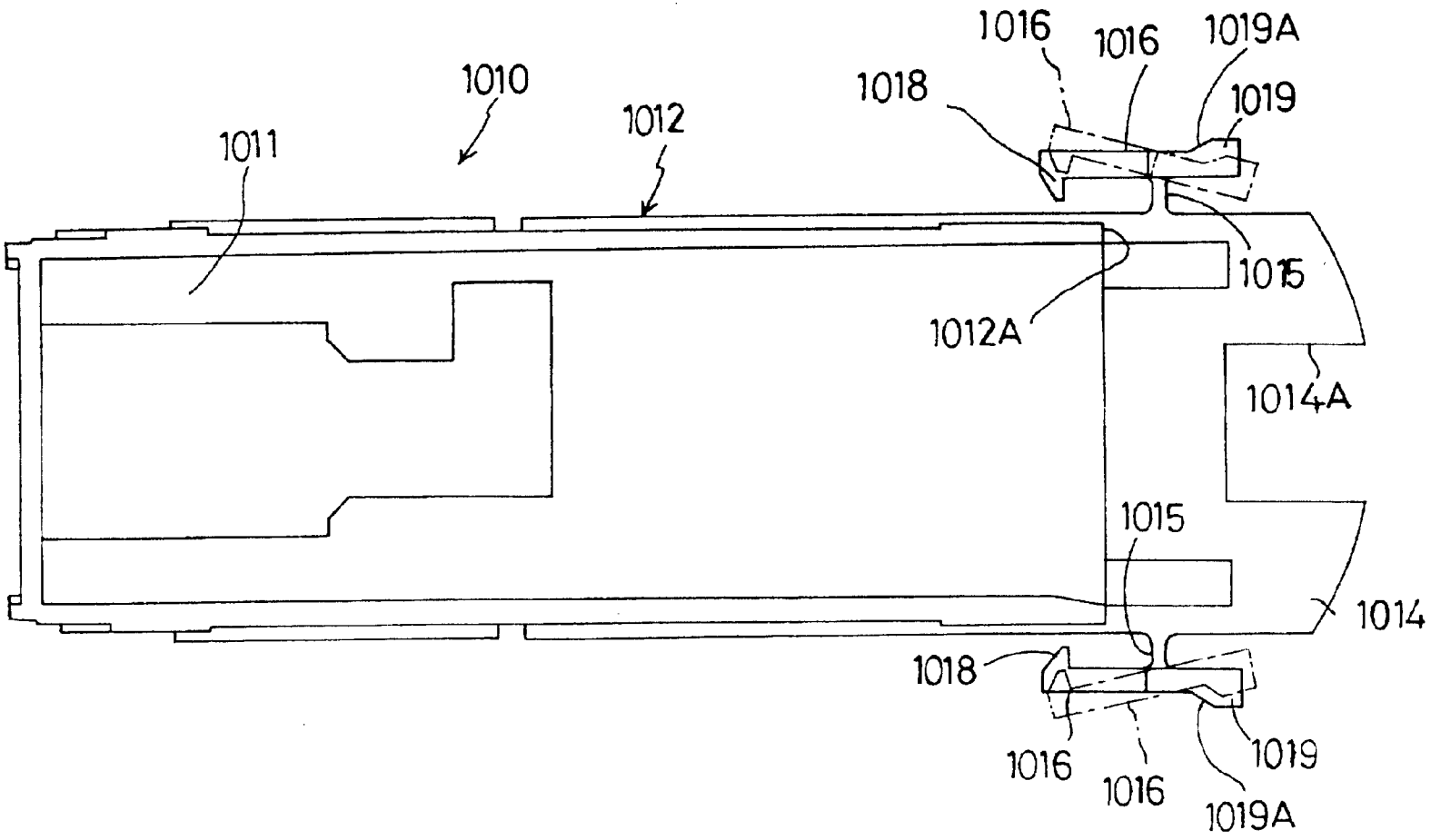
FIG. 27 is a plan view of the cartridge.
Figure 28:
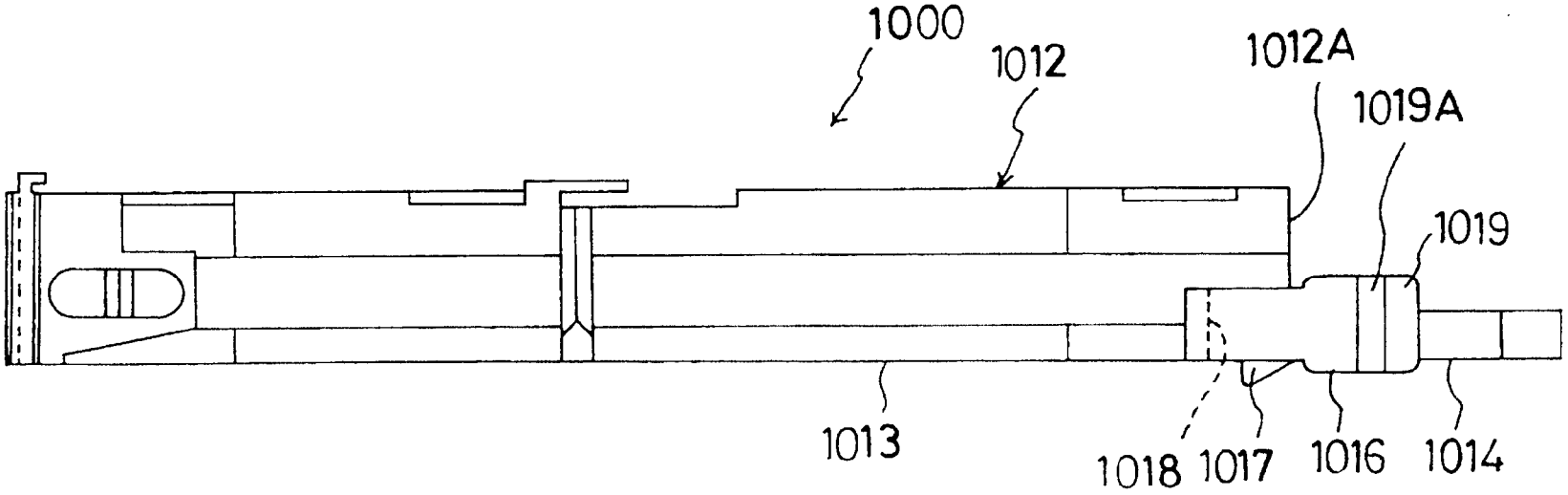
FIG. 28 is a side view of the cartridge shown in FIG. 27.
Figure 29:
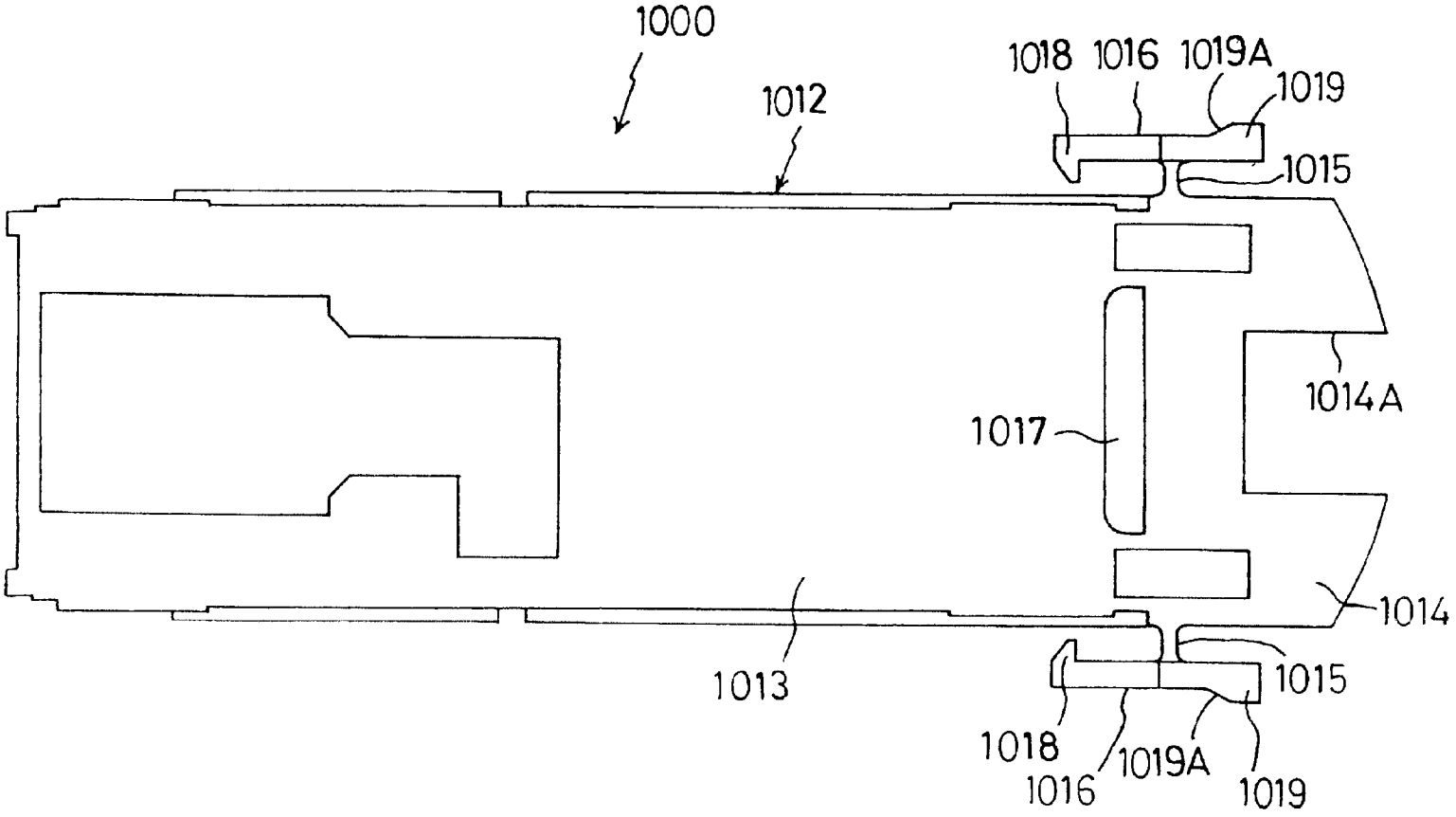
FIG. 29 is a bottom view showing a bottom of the cartridge.
Figure 30:
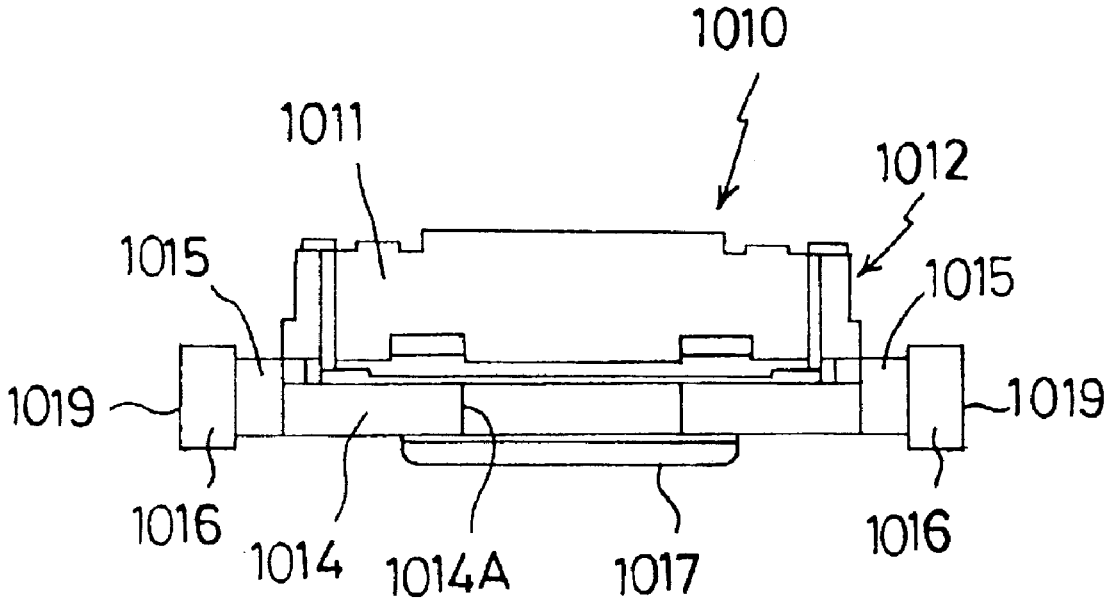
FIG. 30 is a rear view of the cartridge shown in FIG. 27.

As shown in FIGS. 21 and 27, front ends 512A of the anvil portion 512 extend respectively through cutout portions 645 formed in a guide plate 643 of the cartridge 600 which will be described later and enter the drive-out passage 601. As the forming holder 110 goes up and pushes the bent portion 521 of the plate spring 520, the plate spring 520 is bent to a greater extent than is shown in FIGS. 7 and 8. This bending motion causes the anvil 510 to move forward and the front end part 512A of the anvil portion 512 is retracted from the drive-out passage 601 in the cartridge 600.

[Delivery Mechanism]

Figure 9:
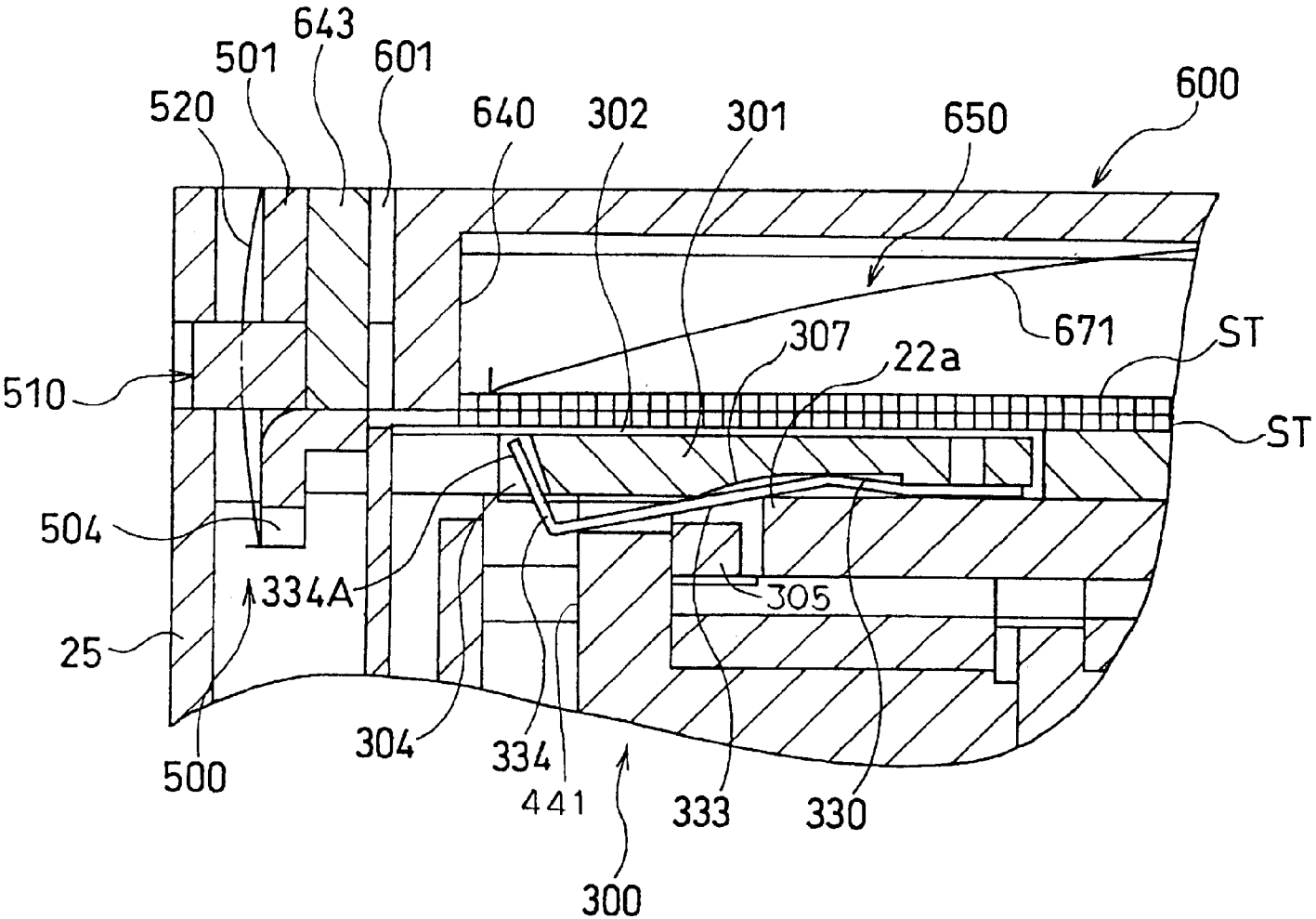
FIG. 9 is an explanatory diagram showing a positional relation between a slider and sheet staples accommodated within the cartridge.
Figure 10:
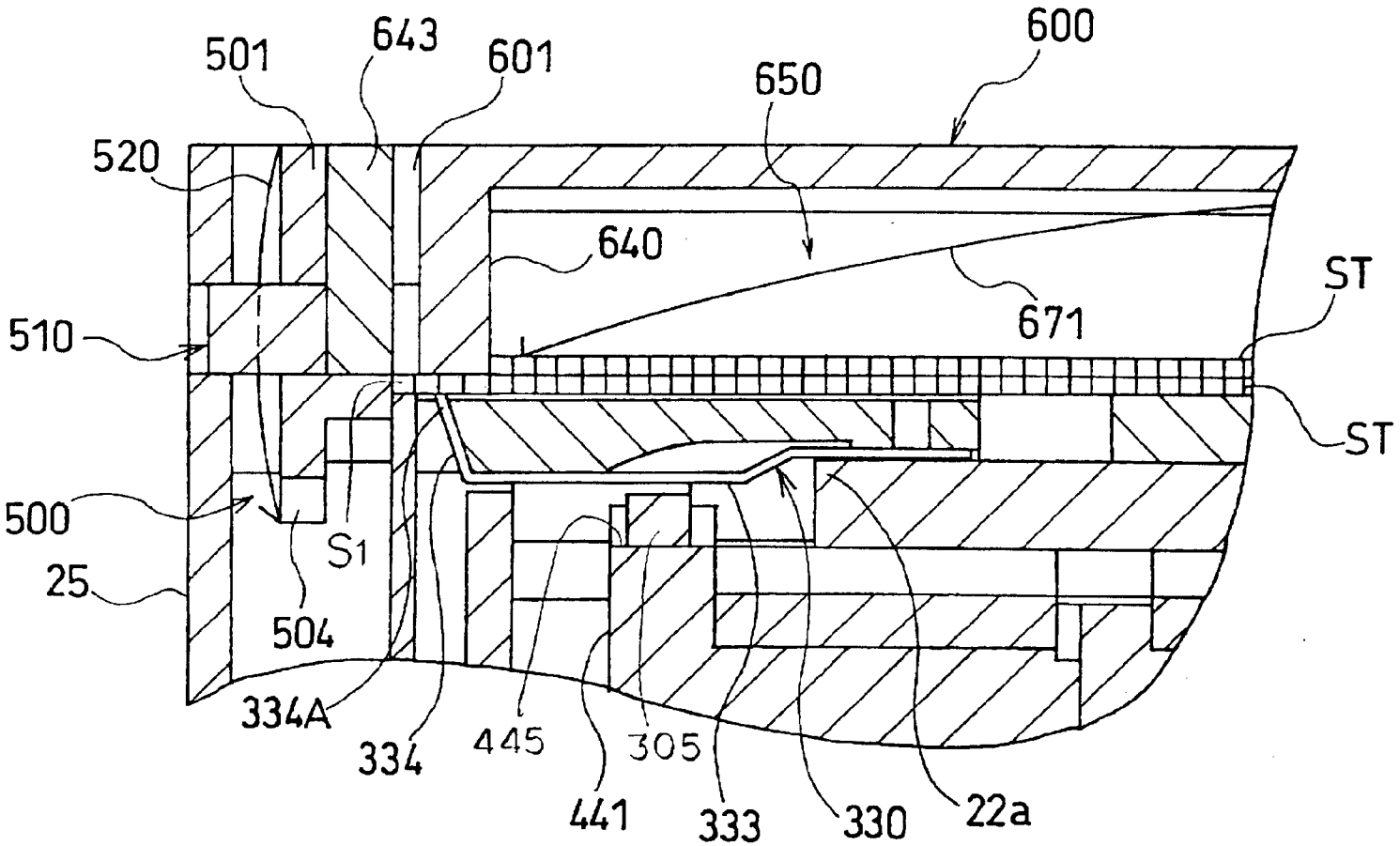
FIG. 10 is an explanatory diagram showing in what state sheet staples are delivered by the slider.

As shown in FIGS. 9 and 10, the delivery mechanism 300 is made up of a slider 301 mounted longitudinally movably, a spring (not shown) which urges the slider 301 forward, and a delivery pawl plate 330 attached to the slider 301.

[Delivery Pawl Plate]

The delivery pawl plate 330 has an elastic portion 333 capable of being deformed elastically. A pawl 334 which projects obliquely upward is formed at a front end of the elastic portion 333 so that a tip end 334A of the pawl 334 pets from an upper surface of the slider 301.

The slider 301 is urged forward by means of a spring 320, but when the forming holder 110 is at its home position, a projection 306 of the slider 301 abuts a disc 441 of the driving gear holder 440 and is stopped at the position shown in FIG. 9. At this time, an edge 22*a* of a cutout portion 22 formed in the ceiling wall 20 of the body case 13 pushes the elastic portion 333 of the delivery pawl plate 330. As a result, the elastic portion 333 gets into a recess 307, which is a part of the base portion 302 of the slider 301, and the tip end 334A of the pawl 334 of the delivery pawl plate 330 is withdrawn from an upper surface of the base portion 302 of the slider 301.

When the driving gear holder 440 rotates and a cutout portion 445 formed in the disc 441 arrives at a predetermined position, the slider 301 gets into the cutout portion 445. That is, the slider 301 moves forward. With this forward movement of the slider 301, as shown in FIG. 10, the elastic portion 333 of the delivery pawl plate 330 is released form the state compressed by the edge 22*a* of the cutout portion 22 formed in the ceiling wall 20 of the body case 13, and the tip end 334A of the pawl 334 of the delivery pawl plate 330 projects from the upper surface of the base portion 302 of the slider 301 to send out the sheet staples ST forward.

With a further rotation of the driving gear holder 440, an inclined surface (not shown) of the disc 441 comes into abutment against the front side of the projection 305 of the slider 301 and pushes the slider 301 backward against the biasing force of the spring 320. In this way, while the driving gear holder 440 rotates once, the slider 301 reciprocates once back and forth.

[Clincher Mechanism]

Figure 11:
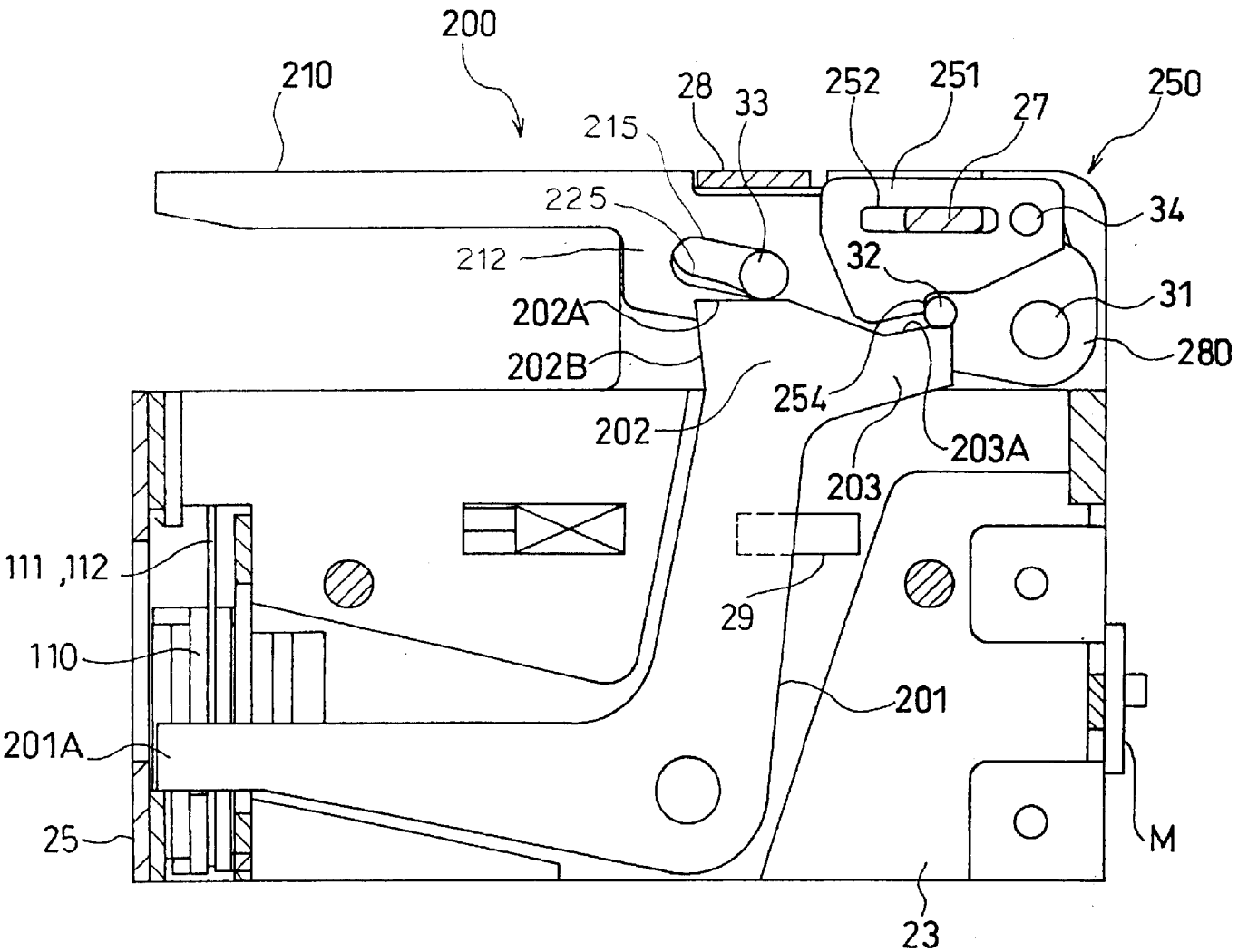
FIG. 11 is a side view showing a construction of a locking mechanism.
Figure 12:
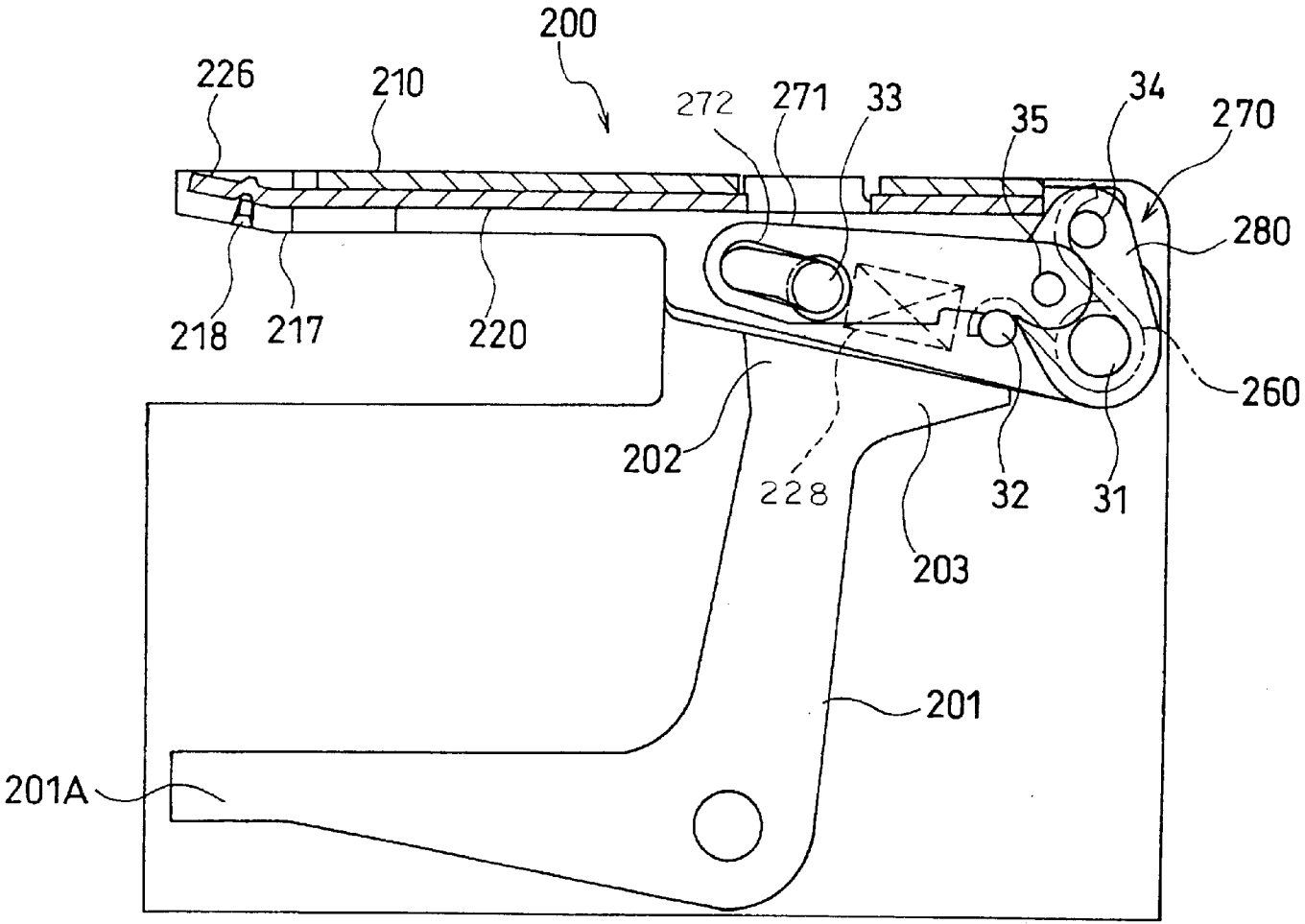
FIG. 12 is a side view showing a construction of a release mechanism.
Figure 13:
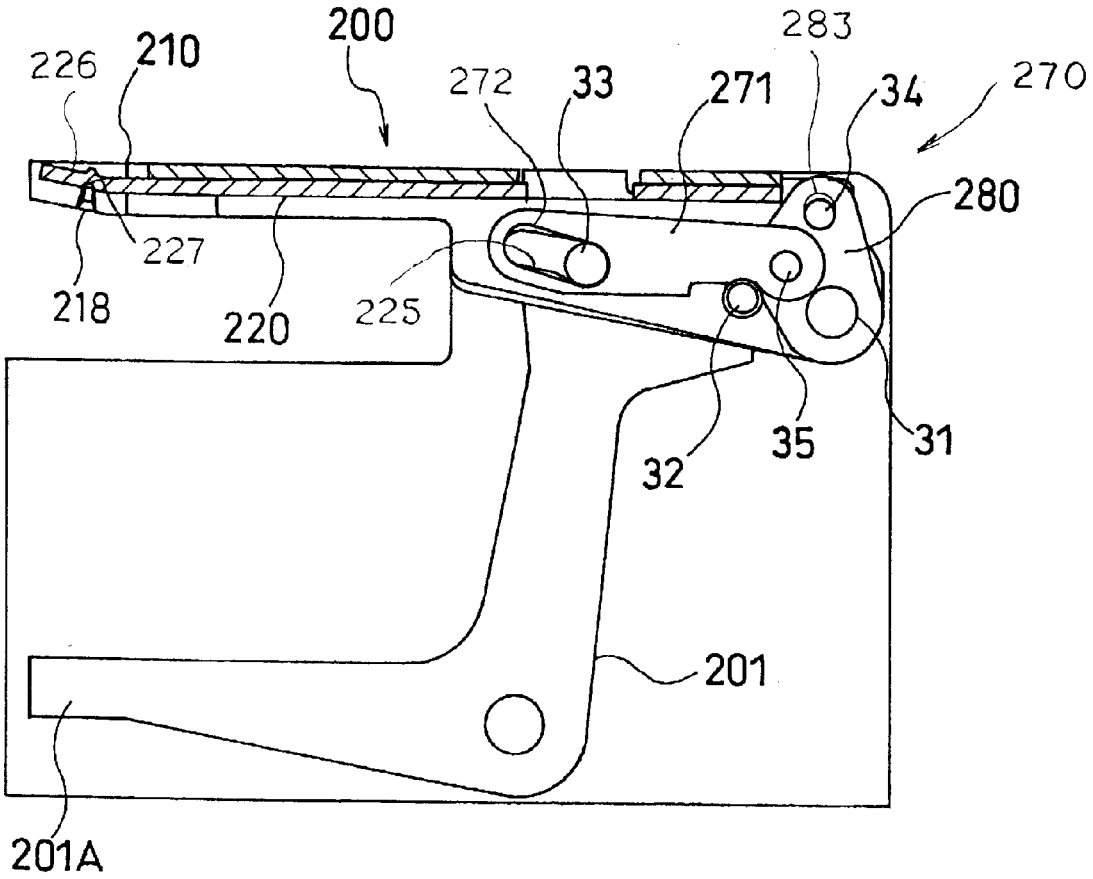
FIG. 13 is an explanatory diagram showing a state of the release mechanism with the forming holder located at a home position thereof.

As shown in FIGS. 11 to 13, the clincher mechanism 200 is composed of a pair of clincher links 201, a clincher guide 210 whose rear portion is secured pivotably to the side plates 23 of the cam body 13, a clincher arm 220 whose rear portion is secured pivotably to the rear portion of the clincher guide 210, a locking mechanism 250 for fixing the clincher guide 210 at a position which results from a predetermined-angle rotation, and a release mechanism 270 for releasing the clincher guide 210 from the state fixed by the locking mechanism 250.

[Clincher Guide]

In a side plate portion 212 of the clincher guide 210 is formed an elongated hole 215 so as to extend obliquely upward on the front side. The clincher guide 210 is pivotable about a shaft 31 which is mounted between the side plates 23 of the body 10. A shaft 32 is secured to the side plate portion 212 and a shaft 33 is inserted into the elongated hole 215 of the side plate portion 212 so as to be movable along the same hole.

[Clincher Arm]

Figure 14:
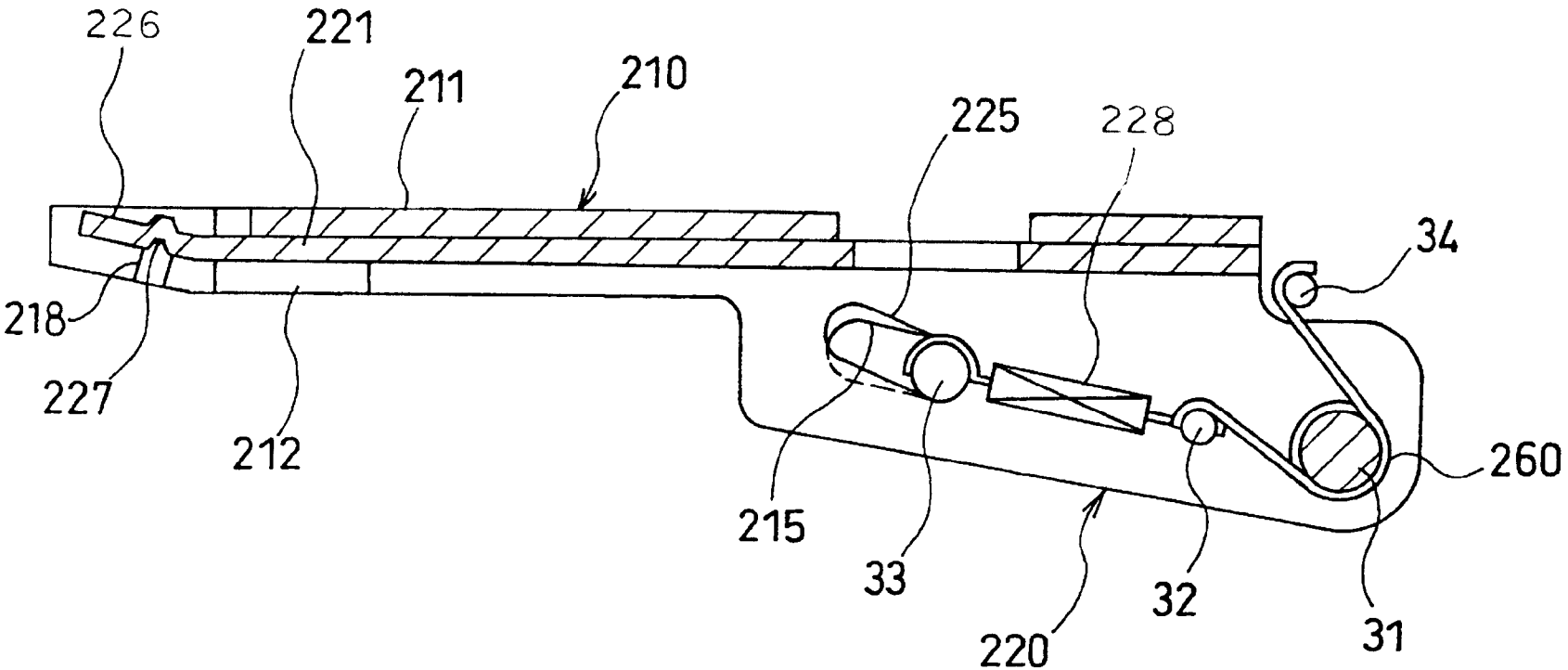
FIG. 14 is an explanatory diagram showing a relation of a clincher guide and a clincher arm to a spring and various shafts.

As shown in FIG. 14, an elongated hole 225 is formed in a side plate portion 222 of the clincher arm 220. The elongated hole 225 is inclined to a greater extent than the elongated hole 216 of the clincher guide 210 with respect to the horizontal direction.

Figure 17:
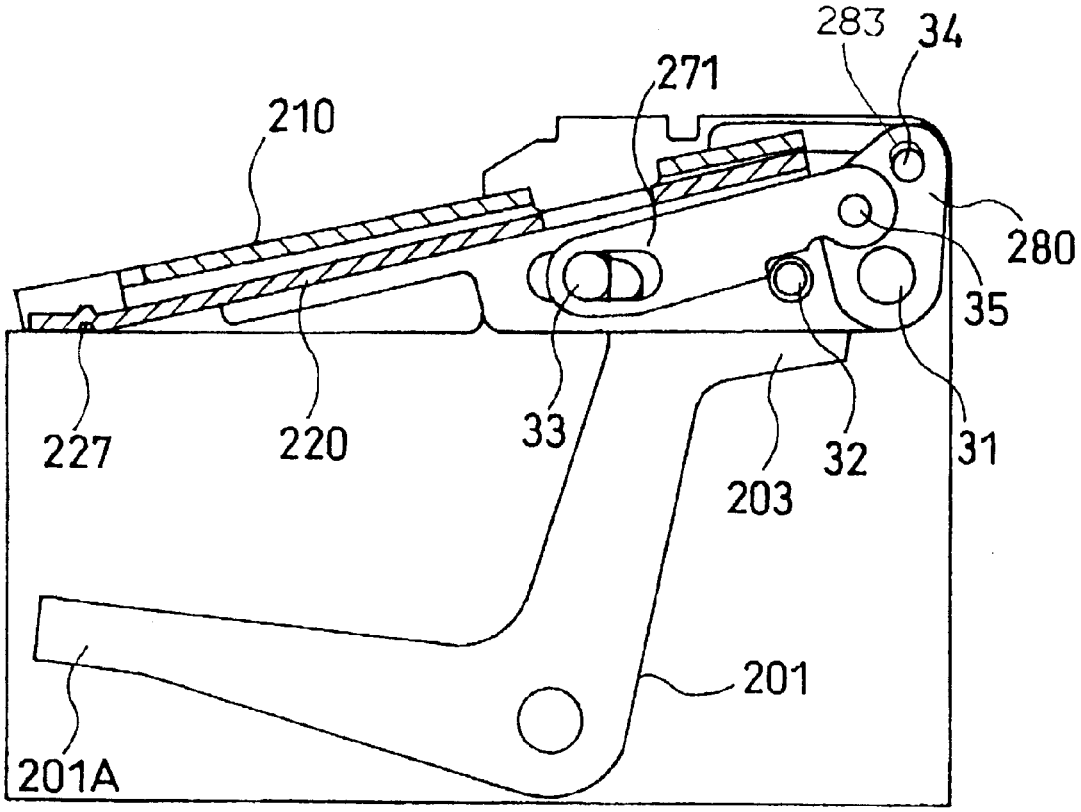
FIG. 17 is an explanatory diagram showing a turning position of the clincher arm relative to the clincher guide.

At a front end of the clincher arm 220 is armed a clincher portion 226, and a groove 227 extending in the transverse direction is formed in a lower surface of the clincher portion 226. The clincher arm 220 is pivotable about the shaft 31. The shaft 33 of the clincher guide 210 is fitted through the elongated hole 225 of the clincher arm 220 so as to be movable along the same hole. Since the elongated hole 225 is inclined at a larger angle than the elongated hole 215, as the shaft 33 moves along the elongated hole 215, the clincher arm 220 turns by a predetermined angle about the shaft 31 with respect to the clincher guide 210, as shown in FIG. 17.

A pair of springs 228 are disposed between the shafts 33 and 32 to urge the shaft 33 backward.

The locking mechanism 250 is made up of fixing plates 251 which are disposed outside both side plate portions 212 of the clincher guide 210 and a spring 260 for moving the fixing plates 251 backward The fixing plates 251 each have a slit-like aperture 252 extending longitudinally. A lower surface 253 of each fixing plate 261 is inclined backwardly upward. In an intermediate position of the lower surface 253 is formed a recess 254 for engagement with the shaft 32.

Projections 27 of the side plates 23 are inserted respectively into the apertures 252 of the fixing plates 251 so as to be movable longitudinally with respect to the side plates 23. Since the projections 27 are each in the shape of a flat plate and the apertures 252 are slit-like, the fixing plates 251 move longitudinally while retaining their horizontal posture. Further, a shaft 34 is secured to rear portions of the fixing plates 251.

The spring 260 is wound round the shaft 31 and one end 260A of the spring 260 is anchored to the shaft 34, while an opposite end 260B thereof is anchored to the shaft 32. The spring 260 urges the shafts 32 and 34 in an opening direction. With this biasing force of the spring 260, the shaft 34, or the fixing plates 251, is urged backward and the circular guide 210 and the clincher arm 220 are urged counterclockwise about the shaft 31.

When the clincher links 201 are located in the position shown in FIG. 11, that is, when the driver holder 101 and the forming holder 110 are in their home positions, the shaft 32 comes into engagement with the recesses 254 of the fixing plates 251 and is abutted against bearing surfaces 203*a* of the clincher links 201. The shaft 33 is adapted for abutment against abutting surfaces 202A of the clincher links 201. Since the shaft 32 is engaged with the recesses 254 of the fixing plates 261, the fixing plates 251 assume the position thereof shown in FIG. 11 and do not move backward despite the biasing force of the spring 260. Further, since the shaft 32 is in abutment against the abutting surfaces 203A of the clincher links 201, the clincher guide 210 and the clincher arm 220 assume their positions shown in FIG. 11 despite the biasing force of the spring 260 and do not turn counterclockwise.

Figure 15:
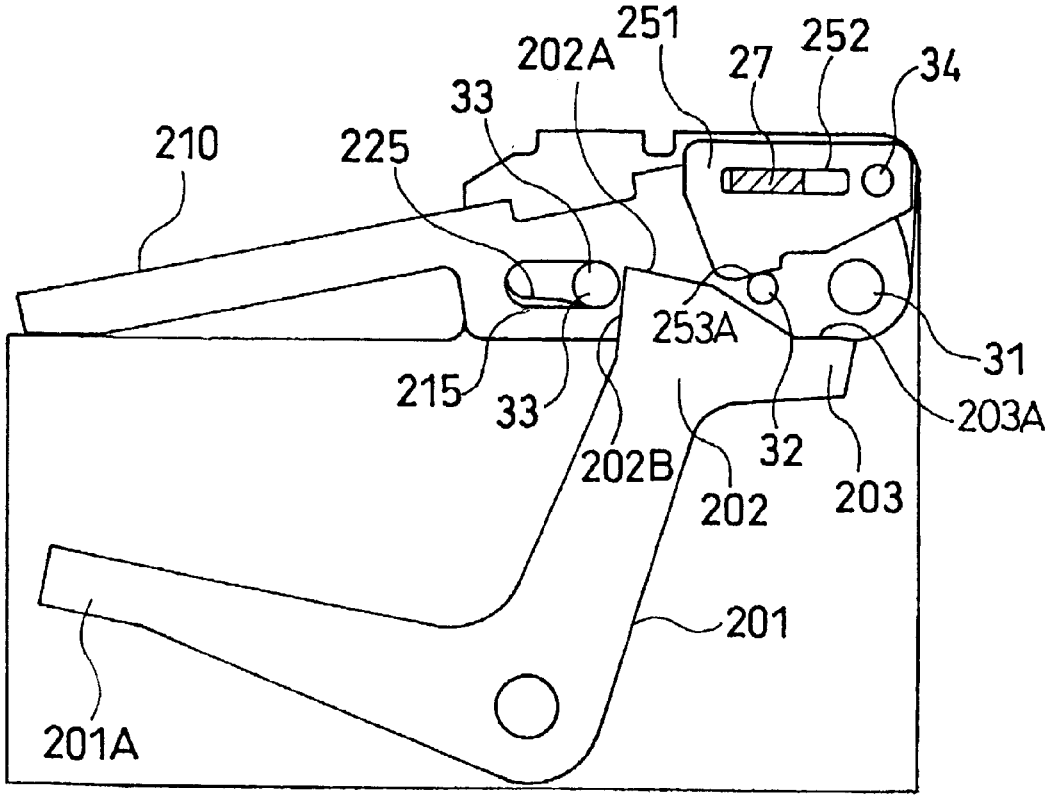
FIG. 15 is an explanatory diagram showing a state in which a front end portion of the clincher guide holds a sheet bundle with rotation of a clincher link.

When the clincher links 201 turn to the position shown in FIG. 15, the shaft 33 becomes disengaged from the abutting surfaces 202A of the clincher links 201 and so is the shaft 32 from the bearing surfaces 208A of the clincher links 201, so that the clincher arm 220 and the clincher guide 210 turn counterclockwise about the shaft 31 under the biasing force of the spring 260.

Figure 16:
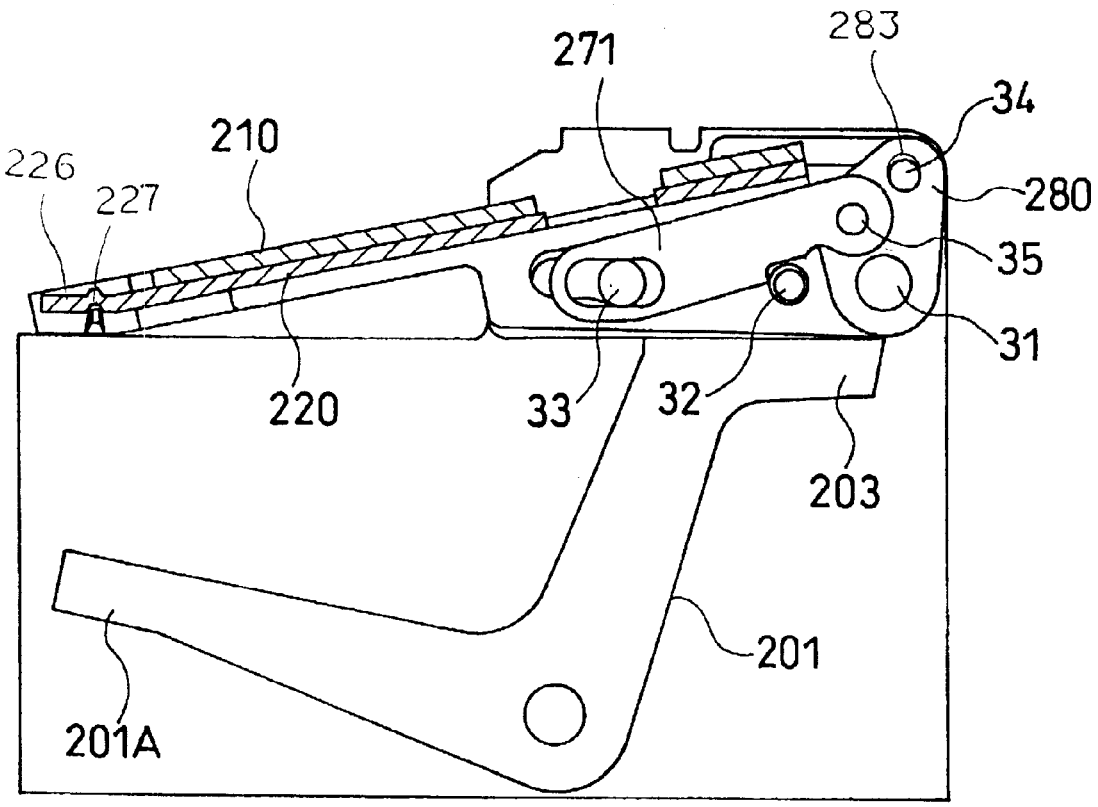
FIG. 16 is an explanatory diagram showing a state of the release mechanism with the sheet bundle held by the clincher guide front end.

In the locking mechanism 250, when the clincher guide 210 and the clincher arm 220 turn to their positions shown in FIGS. 15 and 16 with the biasing force of the spring 260, the fixing plates 251 are moved backward with the same biasing force of the spring 260 and the shaft 32 secured to the clincher guide 210 is brought into abutment against inclined surfaces 253A of the fixing plates 251. Consequently, even if a strong upward force acts on the front end portion of the clincher guide 210 at the time of driving out a staple, the clincher guide 210 is prevented from turning clockwise about the shaft 31 because the shaft 32 is in abutment against the inclined surfaces 256A of the fixing plates 251.

[Release Mechanism]

The release mechanism 270 has the clincher links 201, a pair of first link plates 271 extending in the longitudinal direction, and a pair of second link plates 280 which are generally triangular.

[First Link Plates]

Elongated holes 272 with the shaft 33 inserted therein are formed in front end portions of the first link plates 271 obliquely with respect to the longitudinal direction, while a shaft 35 is secured to rear portions of the first link plates 271.

[Second Link Plates]

The shaft 31 is fitted through the second link plates 280 so that the second link plates are pivotable about the shaft 31, while the shaft 35 is fitted through front end portions of the second link plates 280, with the shaft 34 being fitted through shaft holes 283 formed in upper portions of the second link plates 280. The shaft 34 is vertically movable relatively within the shaft holes 283.

In the release mechanism 270, when the clincher links 201 turn counterclockwise from the position shown in FIG. 17, the abutting surfaces 202B of the clinch links 210 push the shaft 33 forward, so that the first link plates 271 move forward together with the shaft 33 and the second link plates 280 are allowed to turn about the shaft 31. This turning motion of the second link plates 280 causes the fixing plates 251 to move forward through the shaft 34, with the result that the clincher guide 210 is released from its locked state.

[Cartridge]

Figure 18:
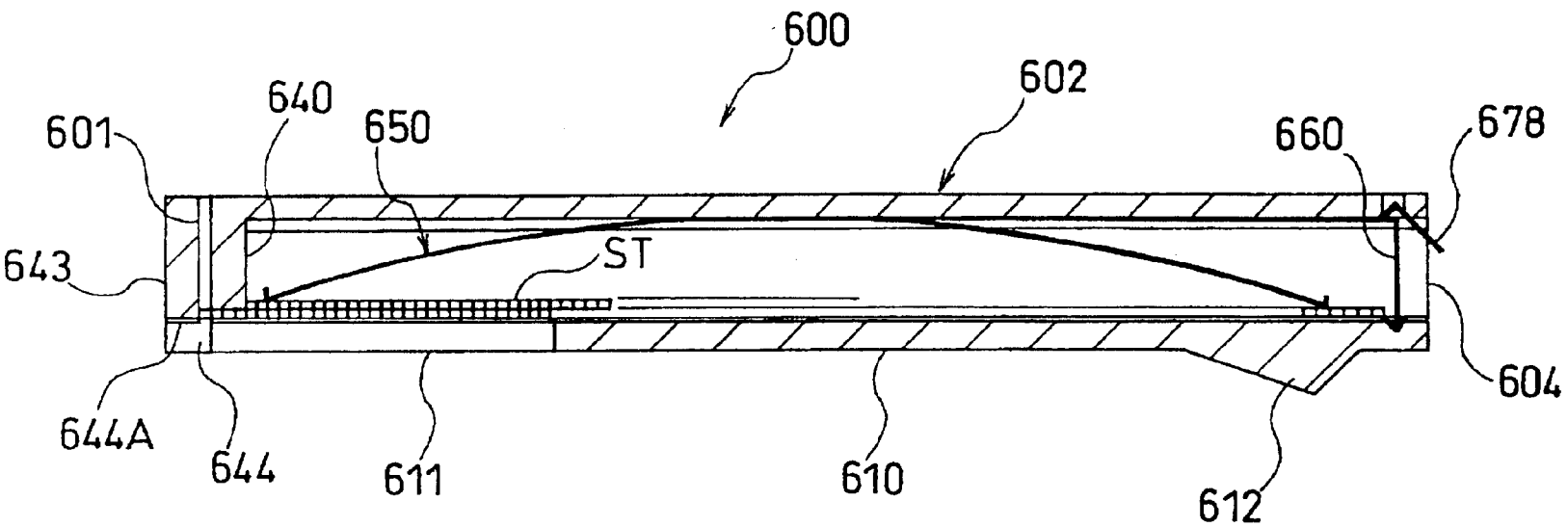
FIG. 18 is a longitudinal sectional view showing a construction of the cartridge.

As shown in FIG. 18, the cartridge 600 is made up of a cartridge body 602 and a plate spring member 650 mounted removably within the cartridge body 602.

[Cartridge Body]

Figure 19A:
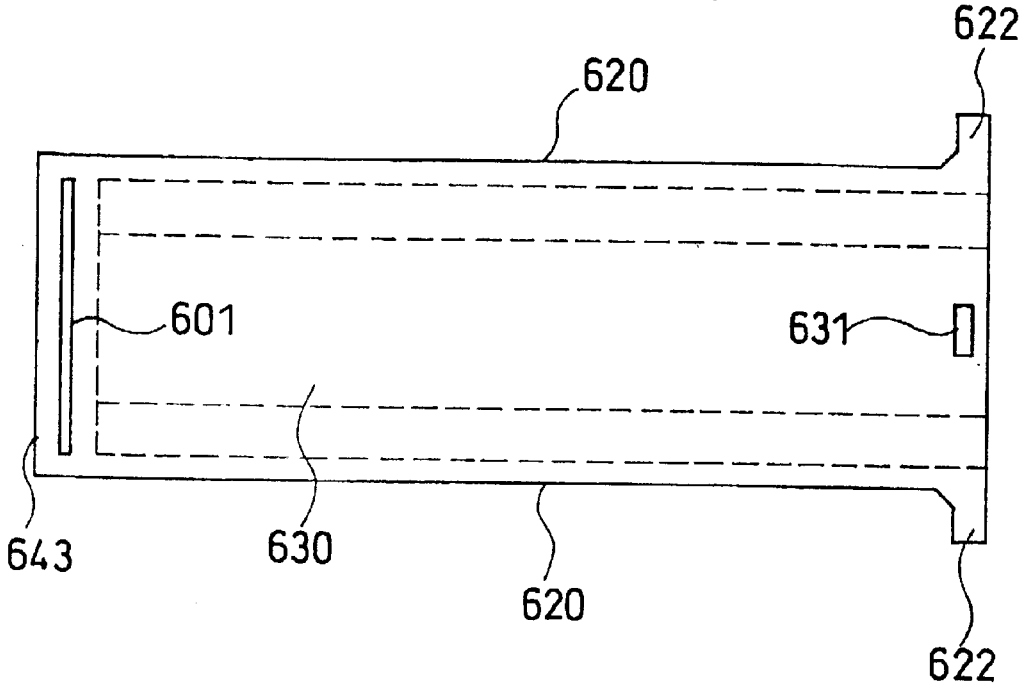
FIG. 19A) is a plan view showing a cartridge body.
Figure 19B:
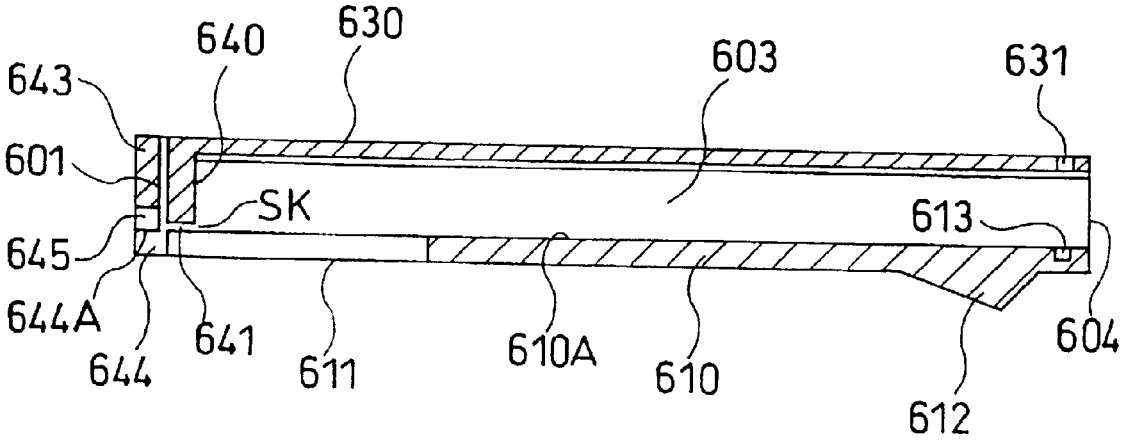
FIG. 19(B) is a longitudinal sectional view of the cartridge body.
Figure 20A:
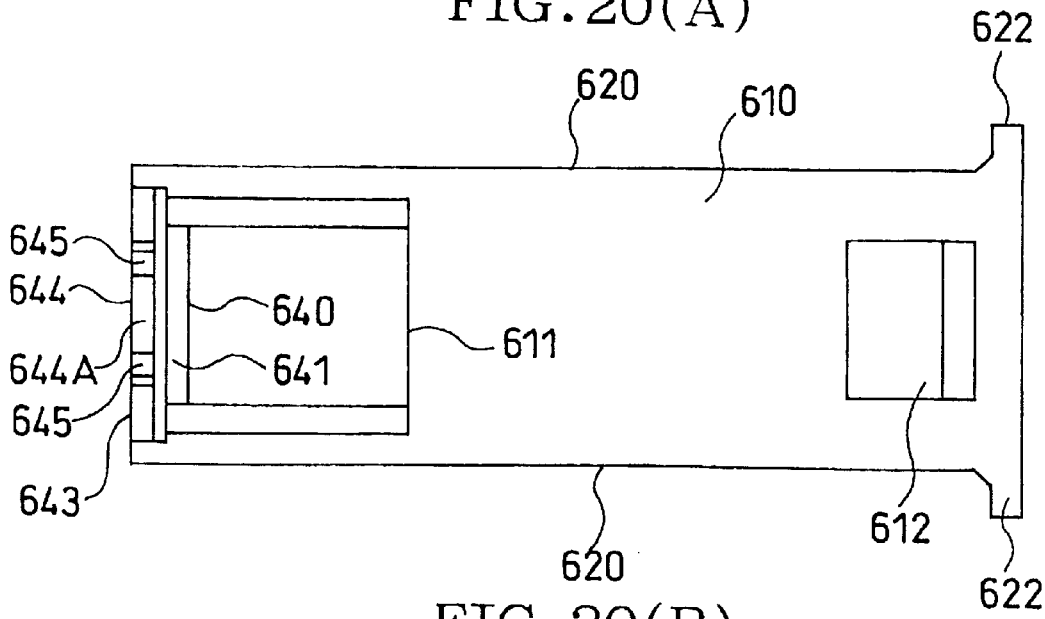
FIG. 20(A) is a bottom view of the cartridge body shown in FIG. 19.
Figure 20B:
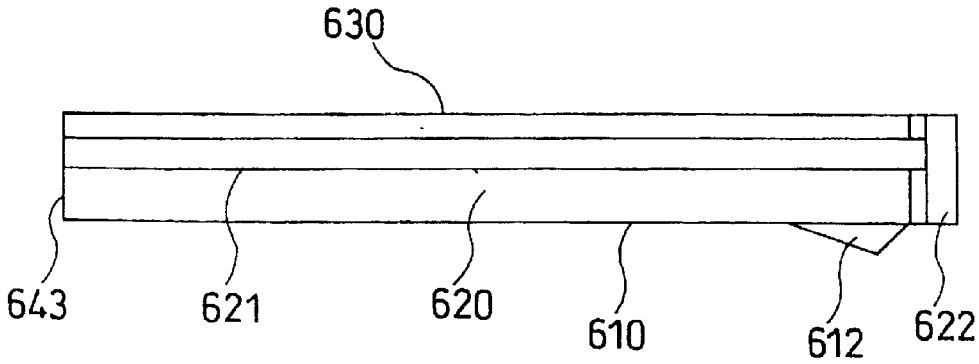
FIG. 20(B) is a side view of the cartridge body shown in FIG. 19.
Figure 20C:
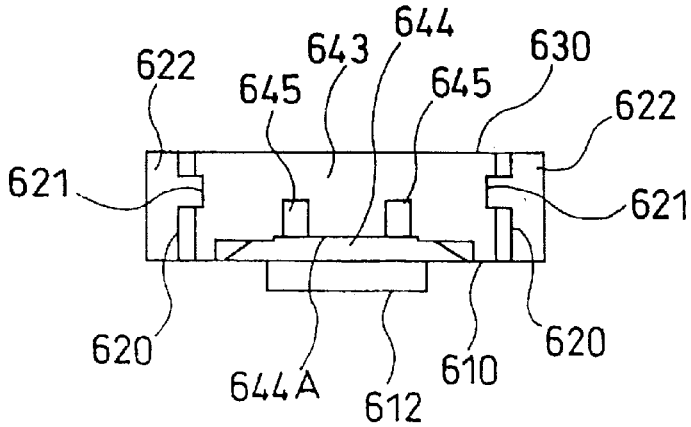
FIG. 20(C) is a front view of the cartridge body shown in FIG. 19.

As shown in FIGS. 19 and 20, the cartridge body 602 has a bottom wall 610, a pair of side walls 620, a ceiling wall 630, and a front-end wall 640, which walls define a receptacle chamber 603 for accommodating sheet staples ST in a stacked state. When the cartridge 600 is loaded into the stapler body 10, an upper surface of the ceiling all 630 and an upper end face 25A of the front plate 25 of the stapler body 10 become flush with each other. As shown in FIG. 3, the ceiling wall 630 serves as a table for resting a sheet bundle P thereon.

A rear end of the cartridge body 602 is open as an opening 604. In a front portion of the bottom wall 610 is formed an opening 611 having a predetermined width shorter than the staple S length and having a predetermined length in the longitudinal direction, and a projection 612 which project downward is formed on a lower surface of a rear portion of the bottom wall 610, while a recess 613 is armed in an upper surface of the rear portion of the bottom wall 610.

Guide grooves 621 extending longitudinally are formed respectively in outer surface of the side walls 620 and handle portions 622 projecting sideways are formed at rear portions of the side walls 620 respectively. An aperture 631 is formed in a rear portion of the ceiling wall 630 and a gap SK is formed between a lower surface 641 of the front-end wall 640 and an upper surface 610A of the bottom wall 610. The height of the gap SK is set at a value almost equal to the thickness of sheet staples ST.

A guide wall 643 is provided in front of the front-end wall 640 and a drive-out passage 601 is armed between the guide wall 643 and the front-end wall 640. An upper end (one end) of the drive-out passage 601 extends through the ceiling wall 630. A recess 644 is formed in a lower surface of the guide wall 643 so that an upper surface 644A of the recess 644 is substantially flush with the upper surface 610A of the bottom wall 610. A pair of cutout portions 645 are formed within the recess 644.

[Plate Spring Member]

As shown in FIG. 21, the plate spring member 650 is made up of a rectangular bottom plate 651 extending in the longitudinal direction (the right and left direction in FIG.

21), an upright portion 660 standing up from a rear end of the bottom plate portion 651, and a top plate 670 extending forward from an upper end of the upright portion 660.

Figure 22:
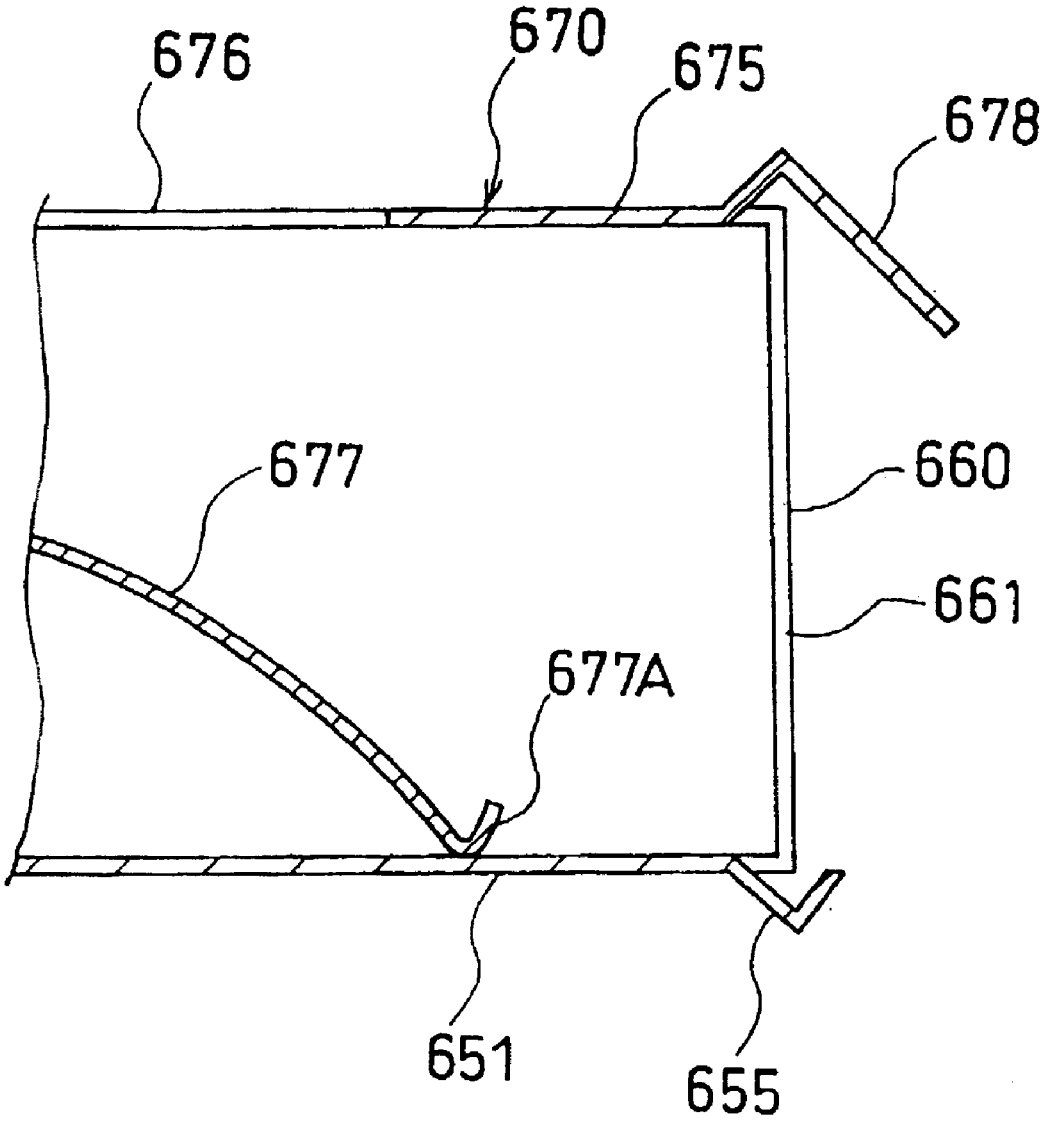
FIG. 22 is a partially enlarged view of the plate spring member shown in FIG. 21.

A cutout portion 652 having predetermined width and depth is armed centrally in a front end of the bottom plate 651. Both sides of the cutout portion 652 serve as a pair of legs 653 and detent pawls 654 are formed at front ends of the legs 653 so as to project obliquely upward. At a rear portion of the bottom plate 651 is formed a V-bent retaining portion 655 projecting downward from a lower surface of the bottom plate 661, as shown in FIG. 22. An opening 661 is formed in an intermediate position of the upright portion 660.

A front portion of the top plate 670 is curved to form a plate spring portion 671 and a recess 672 is formed centrally in a front end of the plate spring portion 671. Both side portions of the recess 672 serve as a pair of leg portions 673. Front ends 673A of the leg portions 673 are bent upward and are abutted against the leg portions 653 of the bottom plate 651. The plate spring portion 671 is formed with a generally triangular aperture 674 to afford a higher elasticity of the plate spring portion 671. A U-shaped cut-in portion 676 is armed in a rear portion 676 of the top plate 670 and the portion surrounded by the cut-in portion 676 is used as a plate spring portion 677. The plate spring portion 677 is curved and a rear end 677A thereof is bent upward and is abutted against the bottom plate 651. The plate spring portions 671 and 677 constitute a plate spring.

At a rear portion of the top plate 670 is formed a hand portion 678 which is bent in L-shape crank or bell crank and which is panted backward from the upright portion 660.

Figure 23:
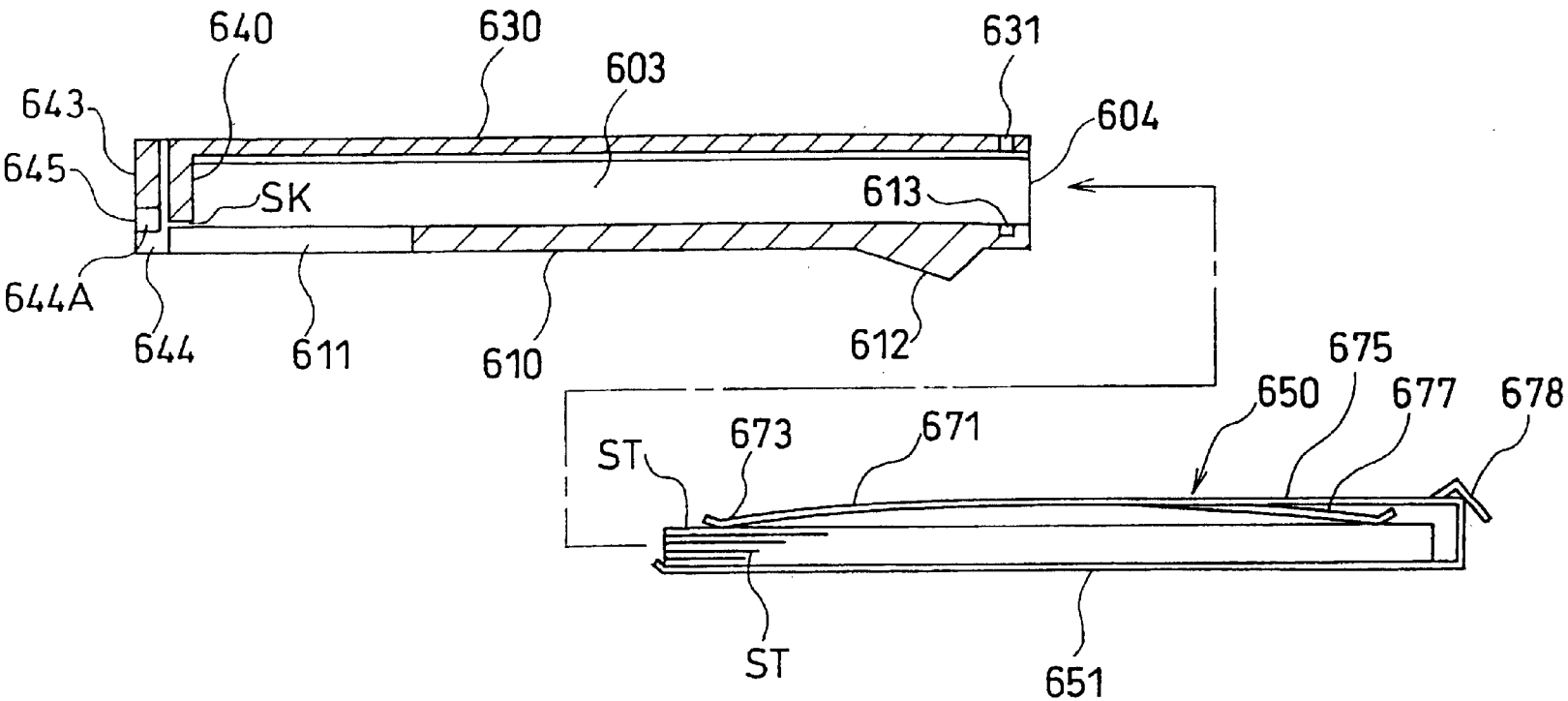
FIG. 23 is an explanatory diagram showing in what manner stacked sheet staples are received into the cartridge body.

For loading sheet staples ST in a stacked state into the cartridge body 602, first, as shown in FIG. 23, sheet staples ST are stacked on the bottom plate 651 of the plate spring member 650 and the thus-stacked sheet staples ST are pinched by the bottom plate 651 and the plate spring portions 671, 677. Then, the plate spring member 650 is inserted, together with the stacked sheet staples ST, into the cartridge body 602 through the opening 604 formed in the rear end of the cartridge body 602. Once the plate spring member 650 is inserted up to a predetermined position in the cartridge body 602, the retaining portion 655 of the plate spring member 650 and a top 678A of the handle portion 678 come into engagement respectively with the recess 613 formed in the bottom wall 610 of the cartridge body 602 and the aperture 631 formed in the ceiling wall 630, whereby the plate spring member 650 is fixed within the receptacle chamber 603 of the cartridge body 602.

The cartridge 600 with the sheet staples ST thus accommodated therein is inserted into the stapler body 10 in the direction of arrow, as shown in FIG. 3. This loading operation is cared out while guide ribs 19 led on an upper wall portion 16 of the body case 13 are allowed to engage the guide grooves 621 formed in the side walls 620 of the cartridge body 602. In this state the cartridge 600 is inserted forward into the stapler body 10 and is loaded thereby. Once the cartridge 600 is loaded into the stapler body 10, as shown in FIG. 3, the projection 612 of the cartridge body 602 engages the valley portion 41 of the fixing spring 40 in the body case 13, whereby the cartridge 600 is fixed to the stapler body 10. Further, a slider 301 secured to the body case 13 gets into the opening 611 of the cartridge body 602.

[Operation of the Motor-operated Stapler]

The operation of the motor-operated stapler 1 constructed as above will be described below.

First, the cartridge 600 thus accommodating the stacked sheet staples ST is loaded beforehand into the stapler body 10, as shown in FIG. 3.

When the motor M is operated with a stapling signal provided from a facsimile device or a printer, the drive shaft 410 rotates via the driving gear 401, planetary gears 425, 437, 444 and gears 424A, 435A, and the cams 470–473 and driving gear holder 440 rotate together with the drive shah 410.

When the cutout portion 445 formed in the disc 441 of the driving gear holder 440 arrives at a predetermined position with rotation of the driving gear holder 440, the projection 305 of the slider 301 becomes disengaged from the disc 441 of the driving gear holder 440, so that with the biasing force of the spring 320 the slider 301 moves forward and gets into the cutout portion 445. With the forward movement of the slider 301, as shown in FIG. 10, the tip end 334A of the pawl 334 of the delivery pawl plate 330 protects from the upper surface of the slider 301, whereby the lowest sheet staple ST accommodated in the cartridge 600 is delivered to the front side.

The sheet staples ST are delivered until the head staple S1 is brought into abutment against a lower portion of the guide wall 643 of the cartridge 600 by the forward movement of the slider 301, as shown in FIG. 10. The head staple S1 which has come into abutment against a lower portion of the guide wall 643 is positioned at one end of the drive-out passage 601.

Then, the forming holder 110 goes up with rotation of the forming cam 472, and with this upward movement of the forming holder 110 the forming plates 111 and 112 begin to from the staple S1 into U-shape. Further, as the driving gear holder 440 rotates, an inclined surface 446 of the disc 441 comes into abutment against the front side of the projection 305 of the slider 301 and pushes the slider 301 backward against the spring resilience.

On the other hand, as the forming holder 110 goes up, the clincher links 201 turn from the position (home position) shown in FIGS. 11 to 13 to the position shown in FIGS. 15 and 16. With this rotation of the clincher links 201, the shaft 33 comes off the abutting surfaces 202A of the clincher links 201 and so does the shaft 32 from the bearing surfaces 203A of the clincher links 201. As a result, with the biasing force of the spring 260, the clincher guide 210 turns counterclockwise about the shaft 31 together with the clincher arm 220.

The clincher guide 210, upon turning to its position shown in FIGS. 15 and 16, pinches the sheet bundle P placed on the ceiling wall 630 of the cartridge 600 shown in FIG. 1. On the other hand, as the clincher guide 210 and the clincher arm 220 rotates, the shaft 32 of the clincher guide 210 becomes disengaged from the recesses 254 of the fixing plates 251, resulting in that the fixing plates 251 move backward under the biasing force of the spring 260. With this movement, the inclined surfaces 253A of the fixing plates 251 comes into abutment against the shaft 32, so that the fixing plates 251 stop at the position thereof shown in FIG. 15. With the fixing plates 251 the clincher guide 210 is locked at its position shown in FIG. 15.

As the forming holder 110 goes up, the bent portion 521 of the plate spring 520 is pushed upward by the forming holder 110 and the plate spring 520 is curved thereby. With this curving motion, the anvil 510 moves forward and the front ends 512A of the anvil portions 512 are retracted from the drive-out passage 601 of the cartridge 600. At this instant the forming holder 110 reaches a top dead center and the staple S1 has already been formed in U-shape.

Thereafter, as the driver cam 470 rotates, the driver holder 101 goes up and the driver 102 pushes the U-shaped staple S1 into the drive-out passage 601 and drives it out from the opposite end of the drive-out passage 601. While being driven out from the opposite end of the drive-out passage 601, both leg portions Sa of the staple S1 pierce the sheet bundle P.

Upon arrival of the driver holder 101 at its top dead center, the staple S1 is driven out completely from the opposite end of the drive-out passage 601.

Thereafter, the forming holder 110 goes down with rotation of the forming return cam 473. By this downward movement of the forming holder 110 the pushed state of the bent portion 621 of the plate spring 520 by the forming holder 110 is released, whereupon, as shown in FIGS. 7 and 8, the anvil 610 moves backward with the biasing force of the plate spring 520 and the front ends 512A of the anvil portions 512 pass through the cutout portions 645 formed in the guide plate 643 of the cartridge 600 and advance up to the position just before the drive-out passage 601.

Further, with the downward movement of the forming holder 110, the clincher links 201 turn counterclockwise from the position shown in FIGS. 15 and 16. With this counterclockwise rotation of the clincher links 201, the abutting surfaces 202B of the clincher links 201 push the shaft 33 forward. As a result, the shaft 33 moves forward along the elongated hole 215 of the clincher guide 210, and with this forward movement of the shaft 33 the clincher arm 220 turns about the shaft 31 relative to the clincher guide 210. When the clincher links 201 have turned up to the position thereof shown in FIG. 17, the clincher arm 220 turns up to the position thereof shown in FIG. 17 relative to the clincher guide 210.

With this rotation of the clincher arm 220, both leg portions Sa of the staple S1 which has entered the groove 227 of the clincher portion 226 are bent.

When the shaft 33 moves forward, the first link plate 271 moves forward together with the shaft 33 and causes the second link plate 280 to turn about the shaft 31. As a result, the fixing plates 251 move forward through the shaft 34 to the clincher guide 210.

As the clincher link 201 further turns counterclockwise, the bearing surfaces 203A of the clincher links 201 push up the shaft 32, 50 that the clincher guide 210, together with the clincher arm 220, turns clockwise about the shaft 31 against the biasing force of the spring 260.

When the driver 102 moves down to a predetermined position with the descent of the driver holder 101, the font ends 512A of the anvil portion 512 get into the drive-out passage 601. Then, when the forming holder 110 descends to the home position thereof, the driver holder 101 also descends to the position thereof shown in FIG. 3 and the clincher links 201 turn to the position thereof shown in FIGS. 11 to 13. Then, the shaft 33 comes off the abutting surfaces 202B of the clincher links 201, so that, with the biasing force of the spring 227, the shaft 33 moves backward along the elongated hole 215 of the clincher guide 210. With this backward movement of the shaft 33, the clincher arm 220 turns clockwise about the shaft 31 relative to the clincher guide 210 and moves to the position thereof shown in FIGS. 12 and 13.

Further, the shaft 32 secured to the clincher guide 210 comes into engagement with the recesses 254 of the fixing plates 251 and, with the biasing force of the spring 260, the shaft 33 comes into abutment against the abutting surfaces 202A of the clincher links 201. The microswitch 29 detects the clincher links 201 and the motor M is turned oil According to the cartridge for the motor-operated stapler of this embodiment, the sheet staples ST stacked in the receptacle chamber 603 of the cartridge 600 are pressed down by the plate spring portions 671 and 677, so the plate spring portions 671 and 677 become flat when pressed and therefore, as a space for the plate spring portions 671 and 677, it suffices to ensure only a space corresponding to the thickness of the plate spring portions 671 and 677. Consequently, even if the height of the receptacle chamber 603 is low, it is possible to increase the number of stacked sheet staples ST. Moreover, since the plate spring member 650 is formed with the plate spring portions 671, 677 and the detent pawls 654, all that is required for a disassembling work is a mere removal of only the plate spring member 650 from the cartridge 602. Besides, as shown in FIG. 18, by merely pulling the handle portion 678 of the plate spring member 650 backward it is possible to remove the plate spring member 650 from the cartridge body 602. Thus, the removal of the plate spring member 650 can be done in an extremely ample manner.

[Second Embodiment]

Figure 24:
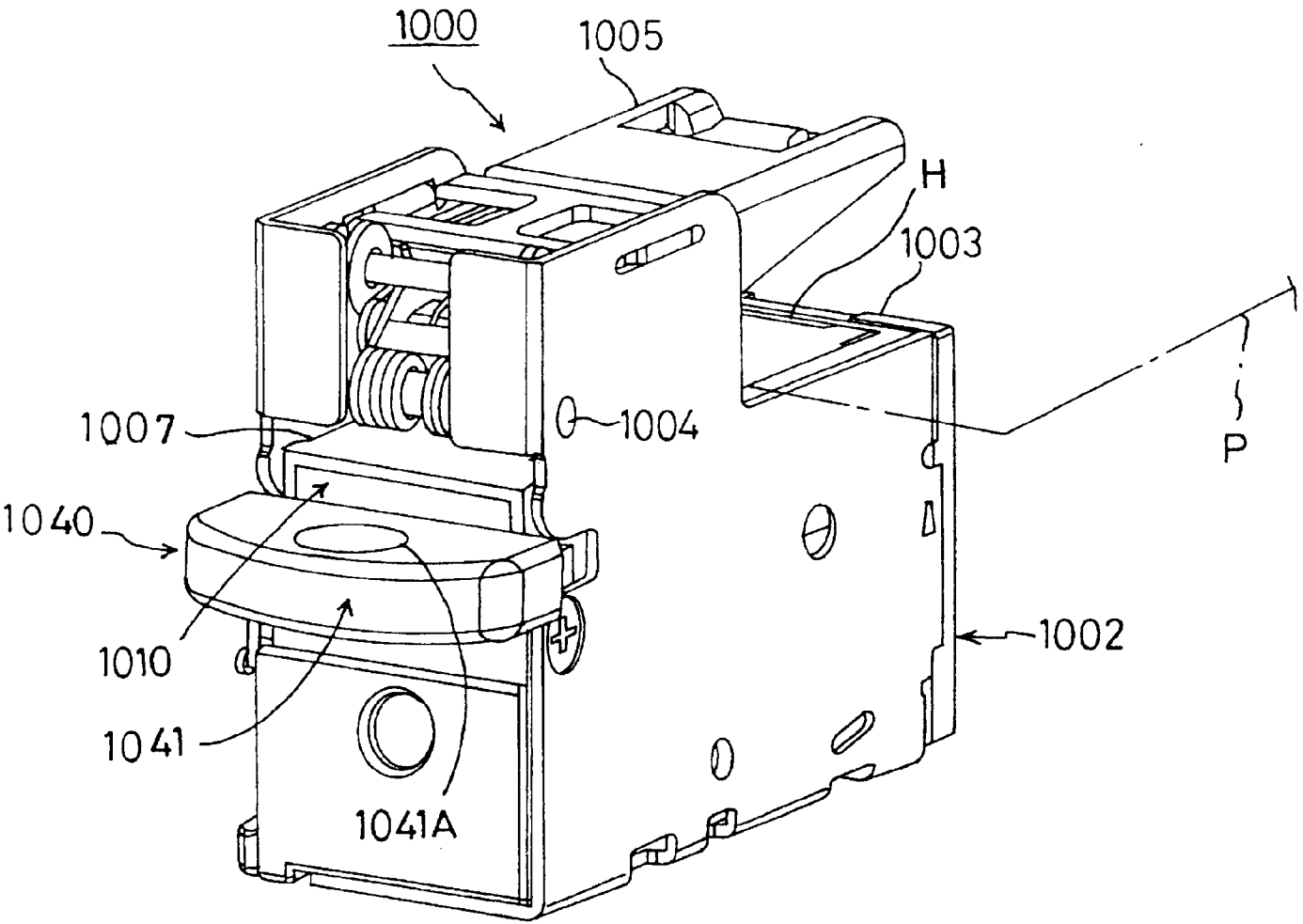
FIG. 24 is a perspective view showing an appearance of a motor-operated stapler according to a second embodiment of the present invention.
Figure 25:
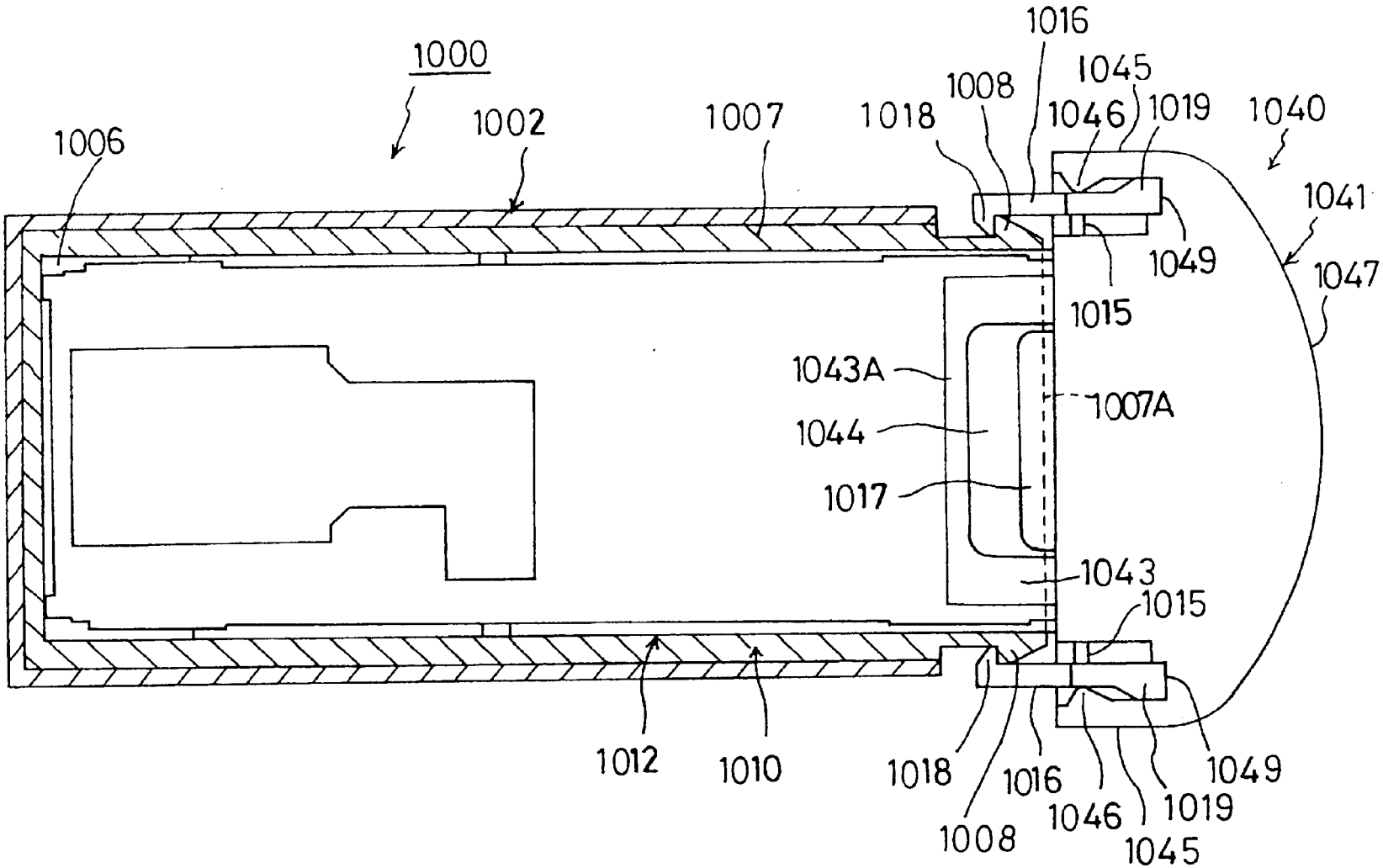
FIG. 25 is a sectional plan view of the motor-operated stapler shown in FIG. 24.

A motor-operated stapler 1000 shown in FIGS. 24 and 25 is provided with a stapler body 1002 and a cartridge 1010 which is loaded removably into a stapler body 1002.

The stapler body 1002 is provided with a sheet rest 1003 for placing a sheet bundle P thereon, a clincher table 1005 which is pivotable about a shaft 1004, and a drive-out mechanism (not shown) which drives out a staple from a drive-out passage H toward the sheet bundle P placed on the sheet rest 1003. The clincher table 1005 is adapted to turn about the shaft 1004 and pinch the sheet bundle P placed on the sheet rest 1003. The clincher table 1005 is provided with a clincher (not shown) for clinching leg portions of the staple thus driven-out as is the case with the first embodiment.

The stapler body 1002 is further provided with a magazine 1007 formed with a cartridge chamber 1006, a delivery mechanism (not shown) for sending out sheet staples (not shown) stacked within the cartridge 1010 to a drive-out passage H, and a drive mechanism (not shown) or driving various mechanisms, which mechanisms are of the same constructions as in the first embodiment.

An opening 1007A is formed in a rear portion of the magazine 1007 and a pair of projections (retaining portions on receptacle portion side) 1008 are formed respectively on both side positions of the magazine rear portion. The cartridge 1010 is loaded into the cartridge chamber 1006 by insertion thereof through the opening 1007A and the cartridge 1010 thus loaded is pulled out from the opening 1007A.

Figure 26:
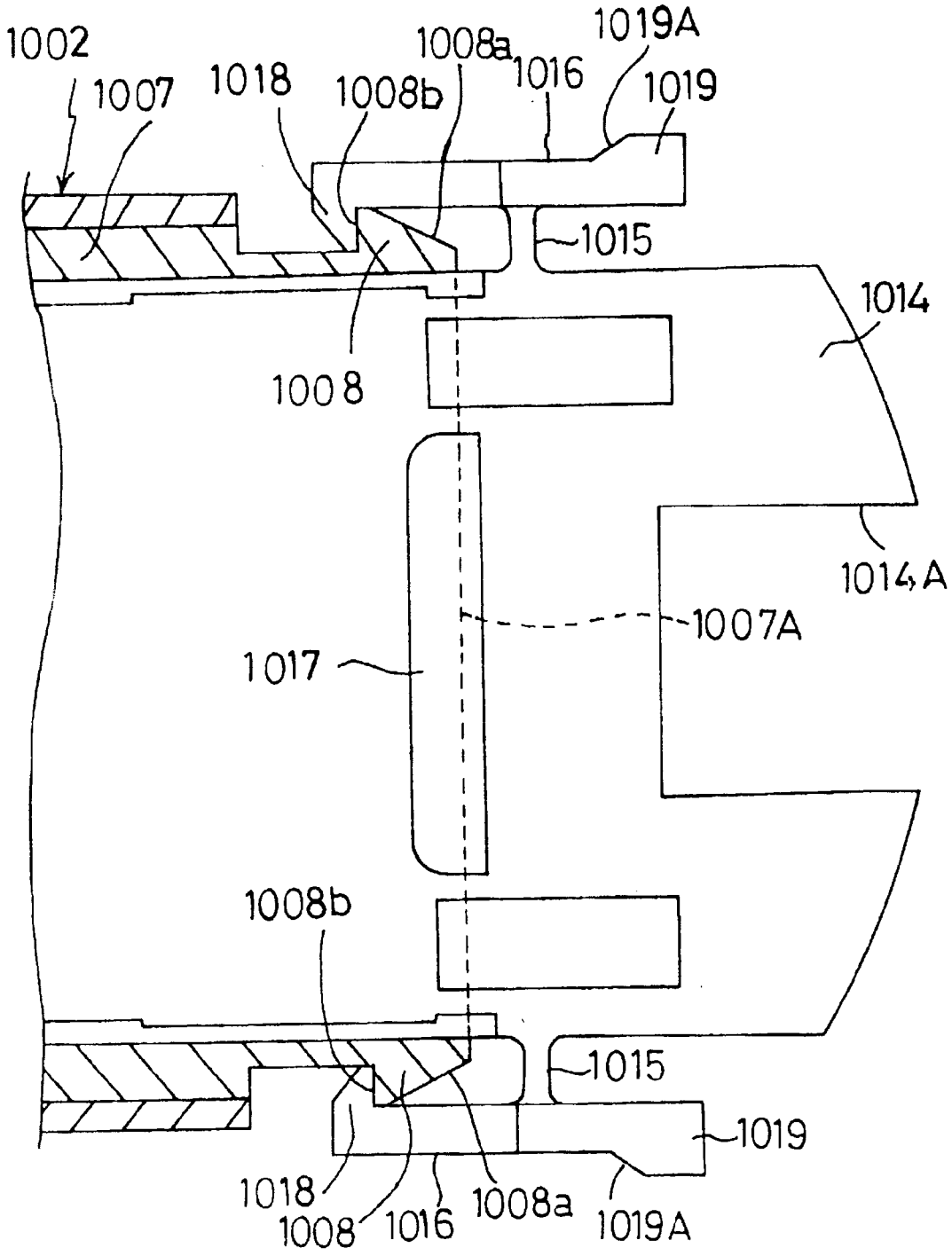
FIG. 26 is a partially enlarged view showing a part of a cartridge.

As shown in FIG. 26, each projection 1008 is formed with an inclined surface 1008*a* which extends sideways to a greater extent toward the left-hand side in the figure (i.e., font side) and is also formed with a retaining surface 1008*b* which is orthogonal to the right and left direction in the figure (ie., longitudinal direction).

[Cartridge]

As shown in FIGS. 27 to 30, the cartridge 1010 is provided with a cartridge body 1012 formed with a receptacle chamber 1011 which accommodates sheet stapes in a stacked state, a rear wall 1014 extending backward from a bottom wall 1013 of the cartridge body 1012, and a pair of arms 1016 formed on both sides of the rear wall 1014 through a pair of support walls 1015.

A recess 1014A is formed in the rear wall 1014 and a downwardly projecting and transversely extending ridge portion (retaining portion) 1017 is formed on a lower surface of a front side of the rear wall 1014.

The arms 1016 extend longitudinally and are respectively provided at their front ends with inwardly projecting retaining projections (retaining portions) 1018. Tho retaining projections 1018 are adapted to engage the retaining surfaces 1008*b* of the projections 1008 of the magazine 1007. Further, sideways projecting portions (pushing portions) 1019 are formed respectively at rear portions of the arms 1016. The protecting portions 1019 are each formed with an inclined surface 1019A which extends sideways to a greater extent toward the rear.

When the projecting portions 1019 are pushed inwards, the pair of arms 1016 tilt so that their front ends become open with respect to each other as indicated with chain lines in FIG. 27 under an elastic force of the support walls 1015. With this tilting motion, the retaining projections 1018 are disengaged from the retaining surfaces 1008*b* of the projections 1008. When the projecting portions 1019 are released from the pushed state, the arms 1016 revert elastically to their original positions indicated with solid lines.

As shown in FIGS. 24 and 25, a knob 1040 capable of moving a predetermined distance in the longitudinal direction is secured to the rear wall 1014 of the cartridge 1010.

Figure 31A:
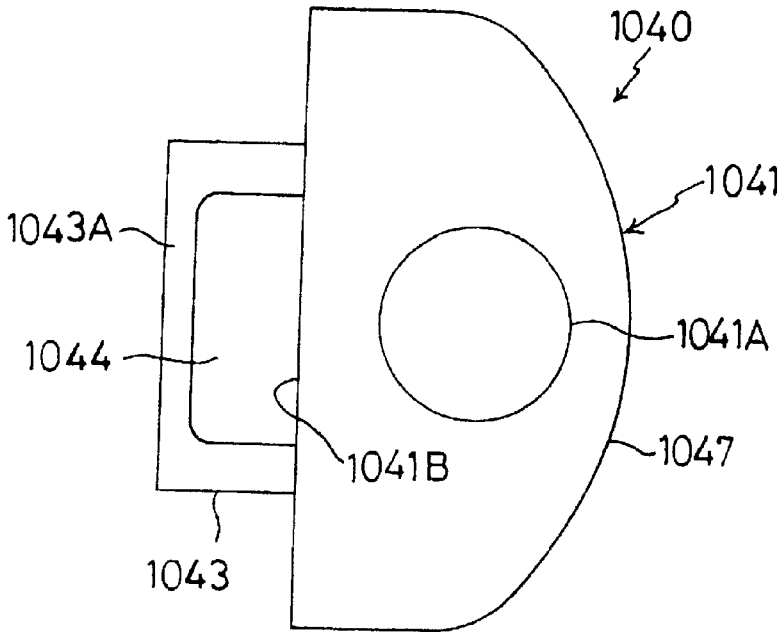
FIG. 31(A) is a plan view of a knob.
Figure 31B:
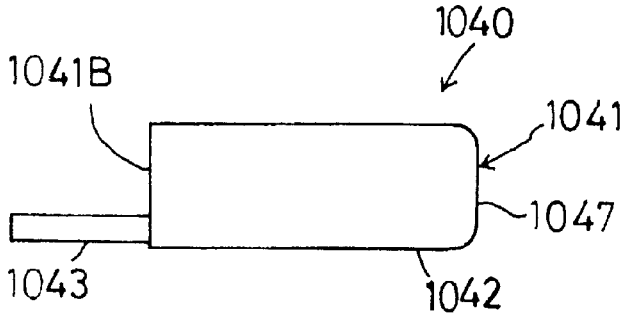
FIG. 31(B) is a side view of the knob.
Figure 31C:
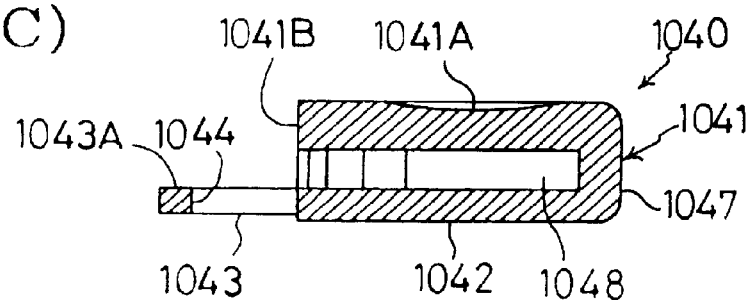
FIG. 31(C) is a cross-sectional view of the knob.
Figure 32A:
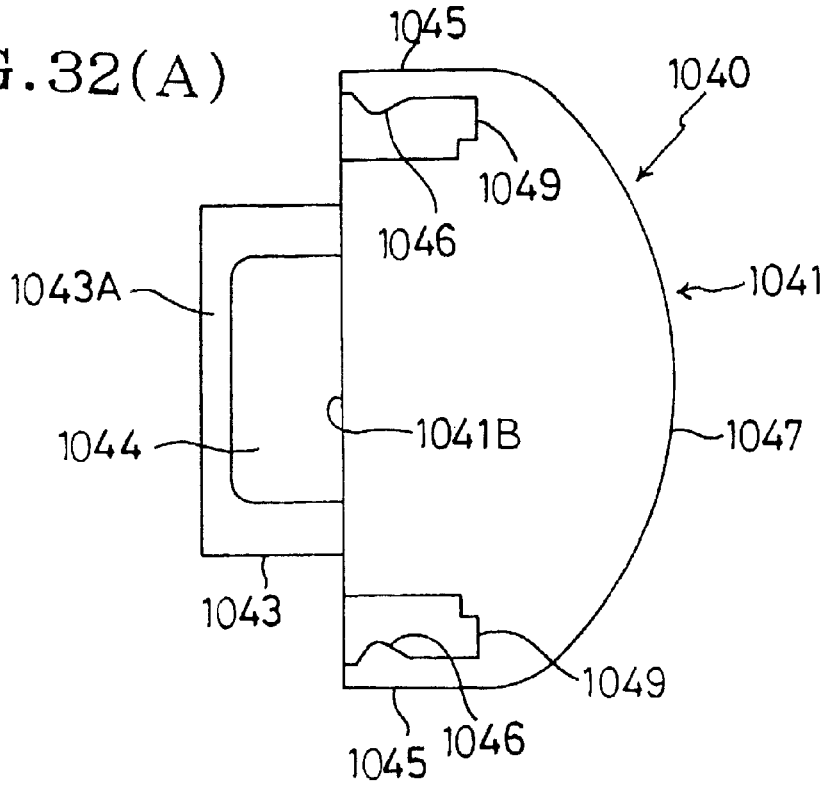
FIG. 32(A) is a bottom view of the knob.
Figure 32B:
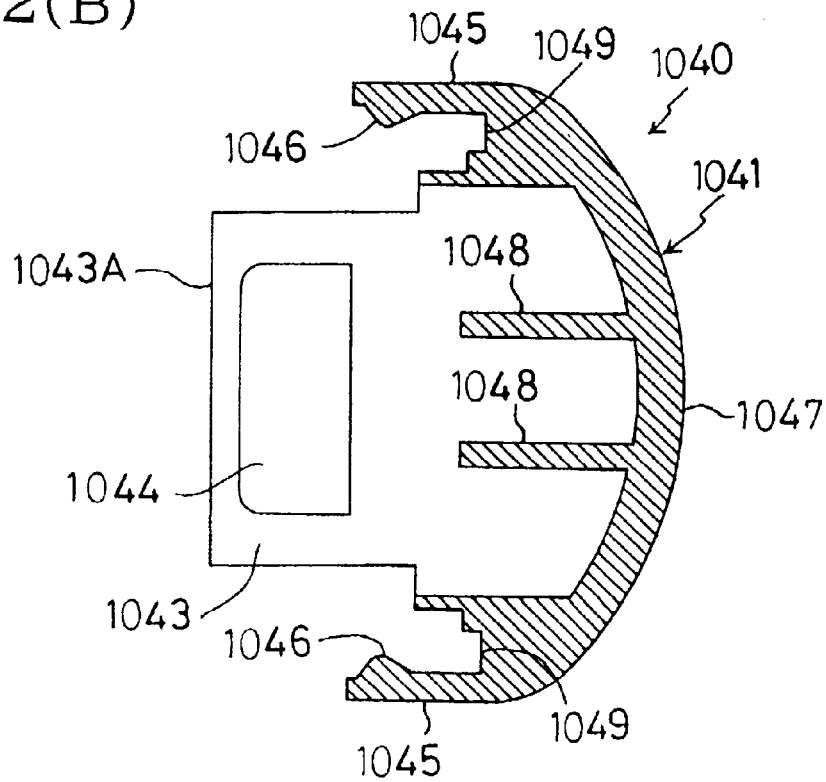
FIG. 32(B) is a sectional plan view of the knob.

As shown in FIGS. 31 and 32, the knob 1040 is semicircular in plan and has a hollow knob body 1041 whose front end face (the left end in FIG. 32) is open. A depression 1041A is formed in an upper surface of the knob body 1041, and a bottom 1042 of the knob body 1041 is formed with a flat plate portion 1043 extending leftwards (forward). In the flat plate portion 1043 is formed a rectangular opening 1044, and a front end 1043A of the flat plate portion 1043, which front end is defined by the opening 1044, functions as an engaging portion for engagement with the ridge portion 1017.

Inside both side wall portions 1045 of the knob body 1041 are formed a pair of inwardly projecting protuberances 1046, and in the side wall portions 1045 are respectively formed recesses 1049 into which rear ends of the projecting portions 1019 of the arms 1016 are to be inserted. A rear wall 1047 of the knob body 1041 is formed with a pair of forwardly extending guide walls 1048.

As shown in FIG. 25, when the rear ends of the projecting portions 1019 of the arms 1016 are inserted into the recesses 1049 of the knob 1040, the tilting motion of the arm 1016 is prevented, so that the retaining projections 1018 of the arms 1016 become incapable of being disengaged from the retaining surfaces 1008*b* of the magazine 1007, whereby the cartridge 1010 is locked to the stapler body 1002.

Figure 33:
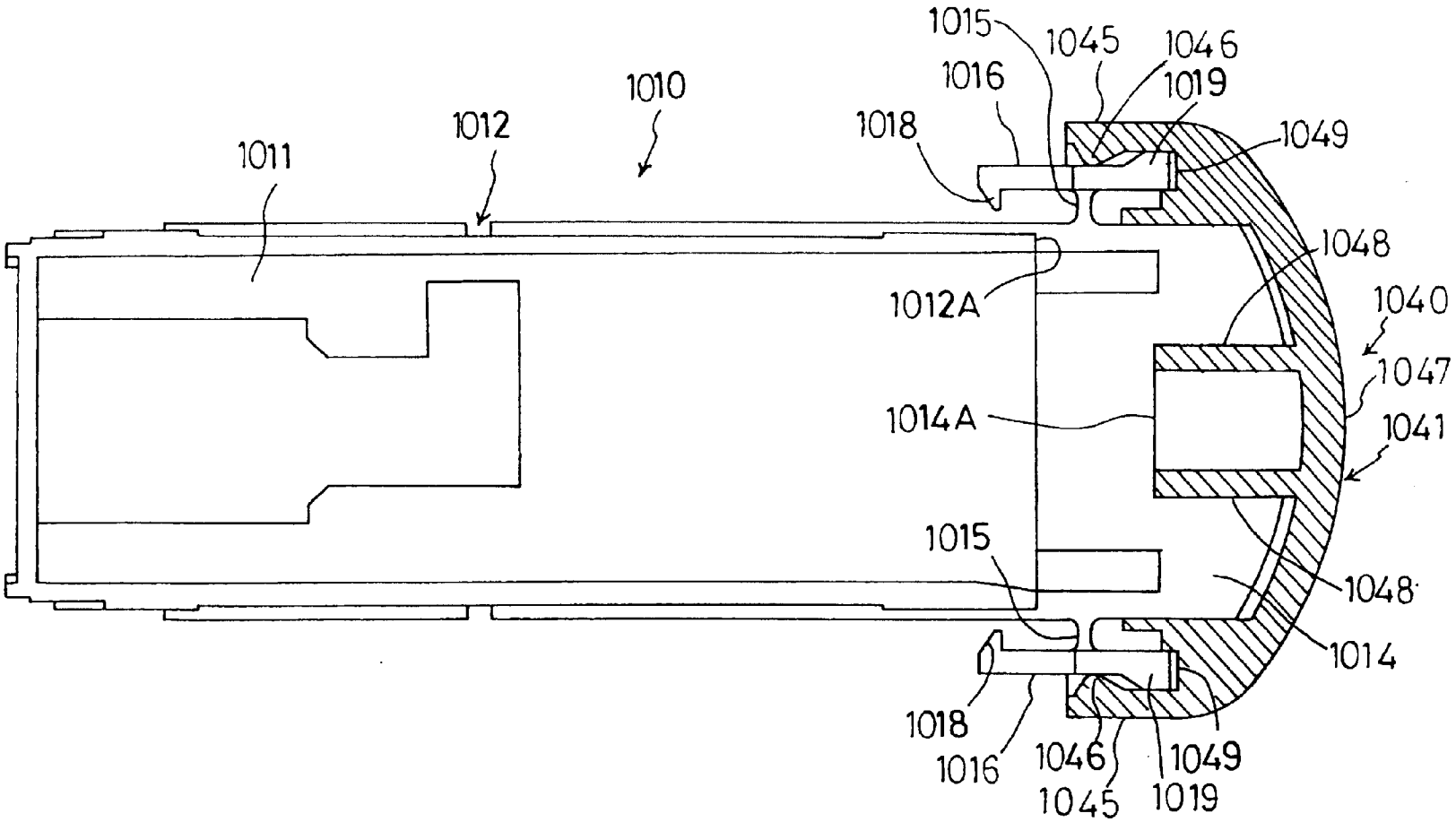
FIG. 33 is an explanatory showing a state in which the knob is mounted to the cartridge.

As shown in FIG. 33, the rear wall 1014 of the a cartridge 1010 is inserted into the knob 1040 and the guide walls 1048 of the knob 1040 are inserted into the recess 1014A of the cartridge 1010. The protuberances 1046 of the knob 1040 are respectively abutted against the outer surfaces of the arms 1016 of the cartridge 1010, and the ridge portion 1017 of the cartridge 1010 is inserted into the opening 1044 of the knob 1040, as shown in FIG. 25.

The knob 1040 is guided so as to move in the longitudinal direction by the guide walls 1048 and is movable longitudinally relative to the cartridge 1010 by a distance corresponding to the gap formed between the opening 1044 and the ridge portion 1017.

The following description is now provided about the operation of the cartridge 1010 constructed as above.

In the case where the cartridge 1010 is loaded into the stapler body 1002 as shown in FIGS. 24 and 25 and where the rear ends of the projecting portions 1019 of the arms 1016 are inserted respectively into the recesses 1049 of the knob 1040, thereby locking the cartridge 1010 to the stapler body 1002, the cartridge 1010 is removed in the following manner.

Figure 34:
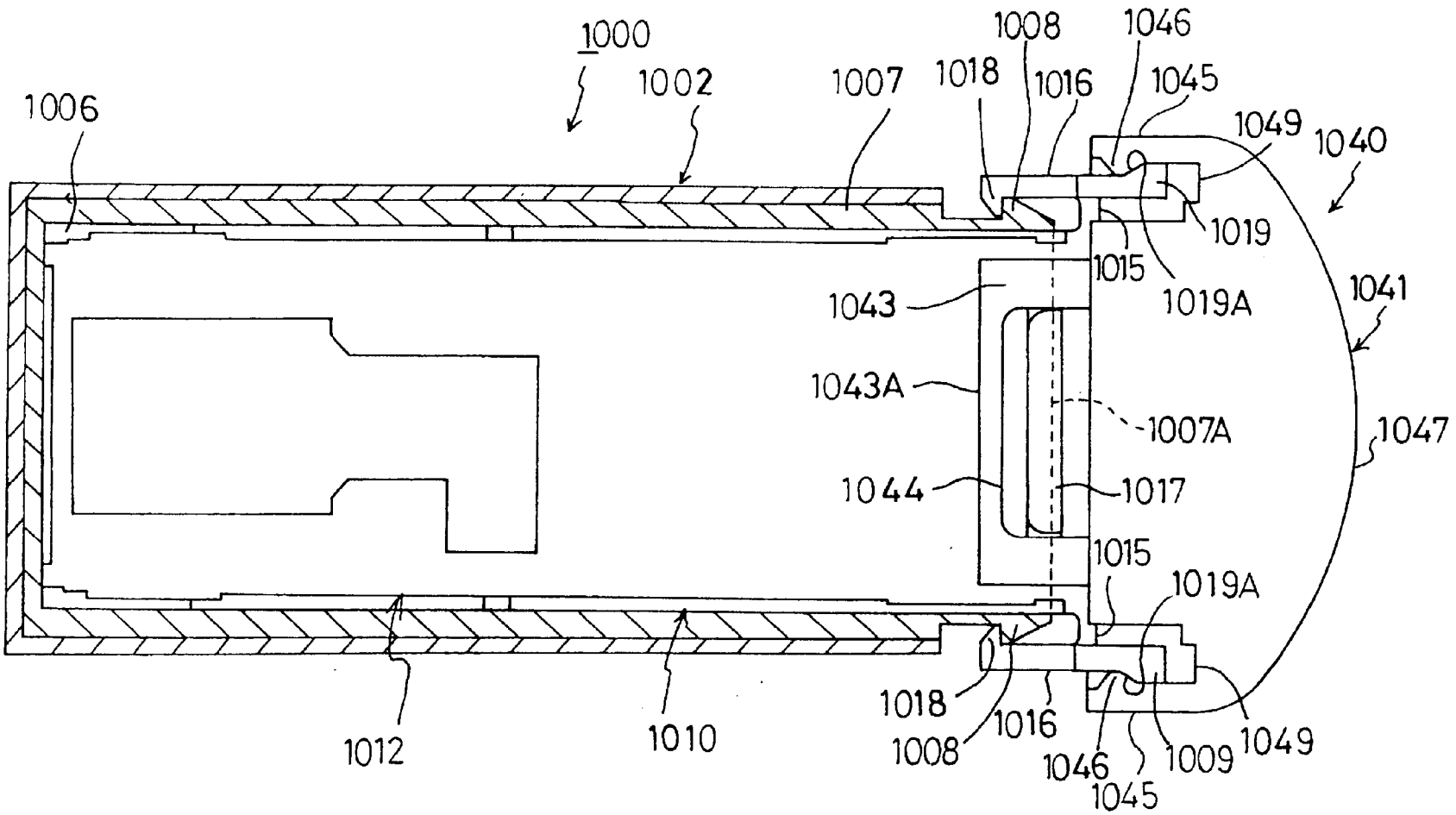
FIG. 34 is an explanatory diagram showing a slightly backward moved state of the knob attached to the cartridge which is loaded into a body of the stapler.

First, if the knob 1040 is pulled out backward with a finger hooked to the recess 1041A formed in the upper surface of the knob 1040, the knob 1040 moves backward relative to the cartridge 1010 and, as shown in FIG. 34, the protuberances 1046 of the knob 1040 come into abutment against the inclined surfaces 1019A of the arms 1016 of the cartridge 1010.

Figure 35:
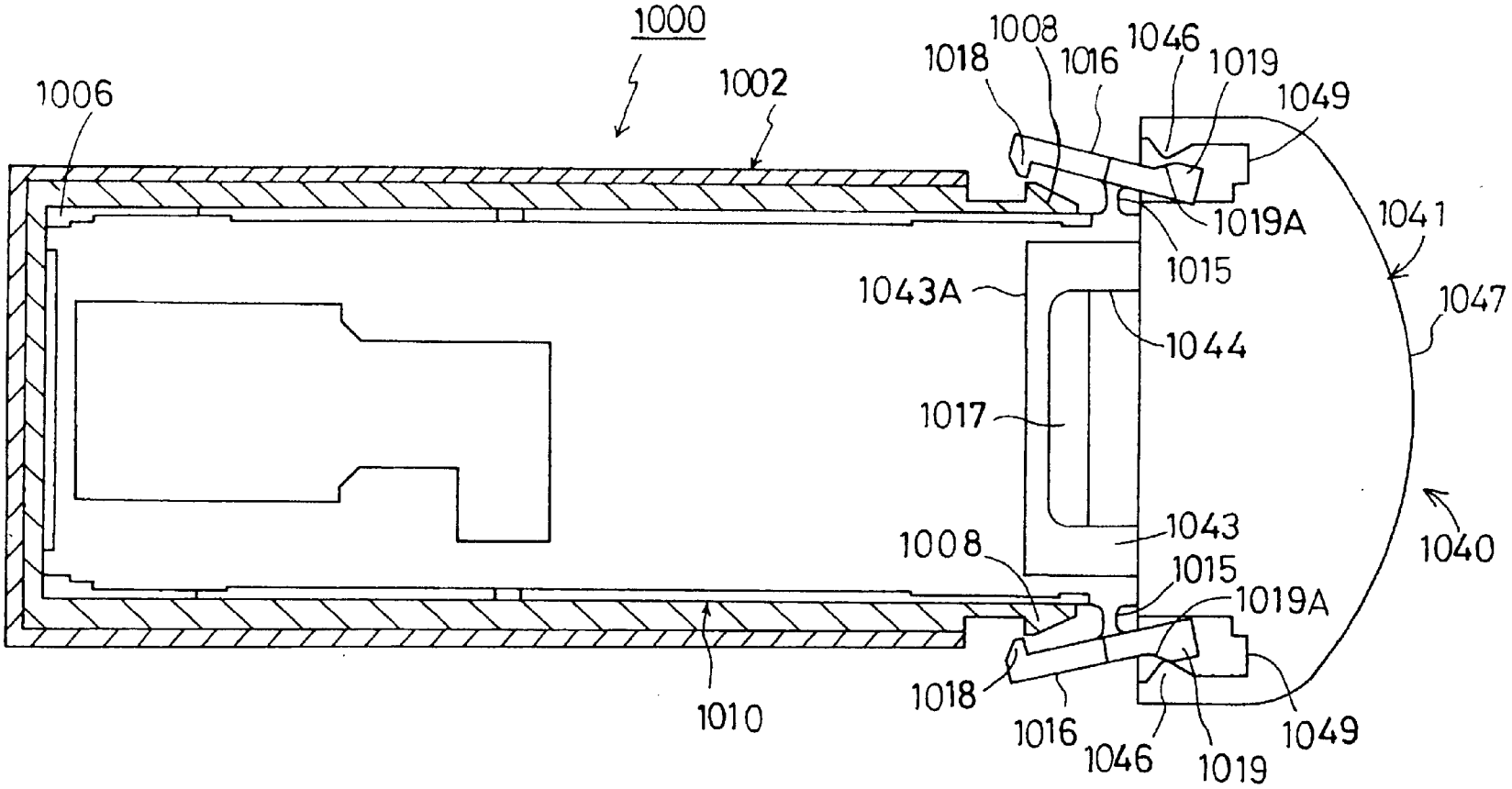

If the knob 1040 is further pulled out backward, the protuberances 1046 of the knob 1040 push the inclined surfaces 1019A of the arms 1016 inwards, so that the arms 1016 tilt as in FIG. 35. With this tilting motion, the retaining projections 1018 of the arms 1016 are disengaged from the retaining surfaces 1008*b* of the magazine 1007 to unlock the cartridge 1010. On the other hand, the front end 1043A of the flat plate portion 1043 of the knob 1040 comes into engagement with the ridge portion 1017 of the cartridge 1010.

Figure 36:
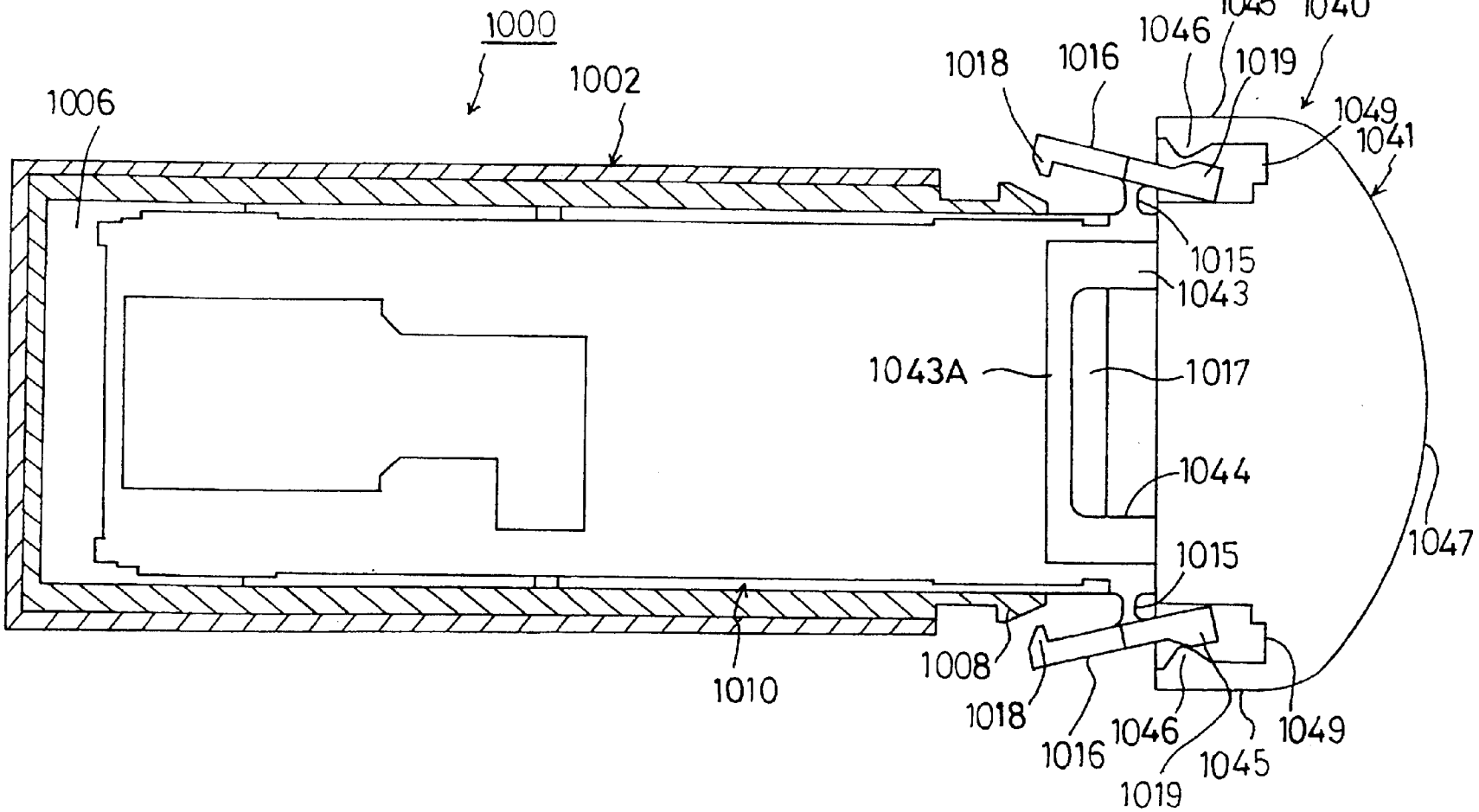
FIG. 36 is an explanatory diagram showing in what state the cartridge is pulled out from the stapler body together with the knob.

As the knob 1040 is further pulled out backward, as shown in FIG. 36, the front end 1043A of the flat plate portion 1043 pulls out the cartridge 1010 backward from the stapler body 1002, whereby the cartridge 1010 is removed from the stapler body 1002.

Thus, by only a sing operation of pulling out the knob 1040 backward, that is, by an operation involving only one action, it is possible to effect both unlocking of the cartridge 1010 and removal of the cartridge 1010.

Figure 37:
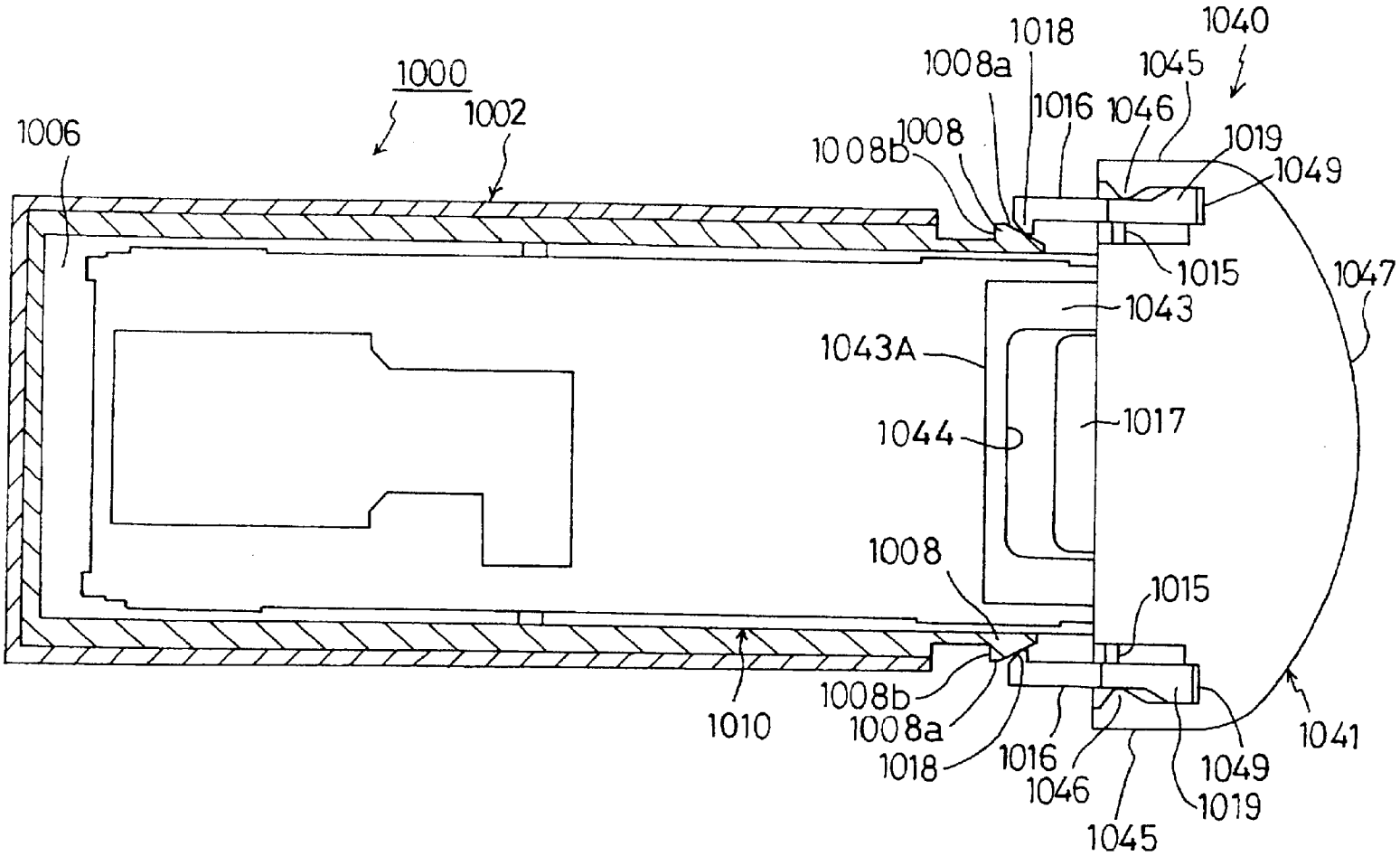
FIG. 37 is an explanatory diagram showing a cartridge loading state.

For loading the cartridge 1010 into the stapler body 1002, a front end portion of the cartridge 1010 is put into the opening 1007A of the magazine 1007 and the knob 1040 is pushed forward, with the result that a font end 1041B of the knob body 1041 comes into abutment against a rear end 1012A of the cartridge body 1012, whereby the cartridge 1010 is pushed by the knob 1040 and is inserted into the cadge chamber 1006. As shown in FIG. 37, upon insertion of the cartridge 1010 into the cartridge chamber 1006, the retaining projections 1018 of the arms 1016 of the cartridge 1010 abut the inclined surfaces 1008*a* of the magazine 1007.

In this state, if the knob 1040 is further pushed and the cartridge 1010 is inserted completely into the cartridge chamber 1006, as shown in FIG. 25, the retaining projections 1018 of the arms 1016 get over the inclined surfaces 1008*a* of the magazine 1007 and engage the retaining surfaces 1008*b* of the magazine projections 1008, whereby the cartridge 1010 is loaded into the stapler body 1002.

On the other hand, the rear ends of the projecting portions 1019 of the arms 1016 are inserted into the recesses 1049 formed in the knob 1040 and the cartridge 1010 is thereby locked to the stapler body 1002.

Thus, by pushing the knob 1040 the cartridge 1010 can be loaded into the stapler body 1002. Besides, the cartridge 1010 is locked to the stapler body 1002.

[Embodiment]

Figure 38:
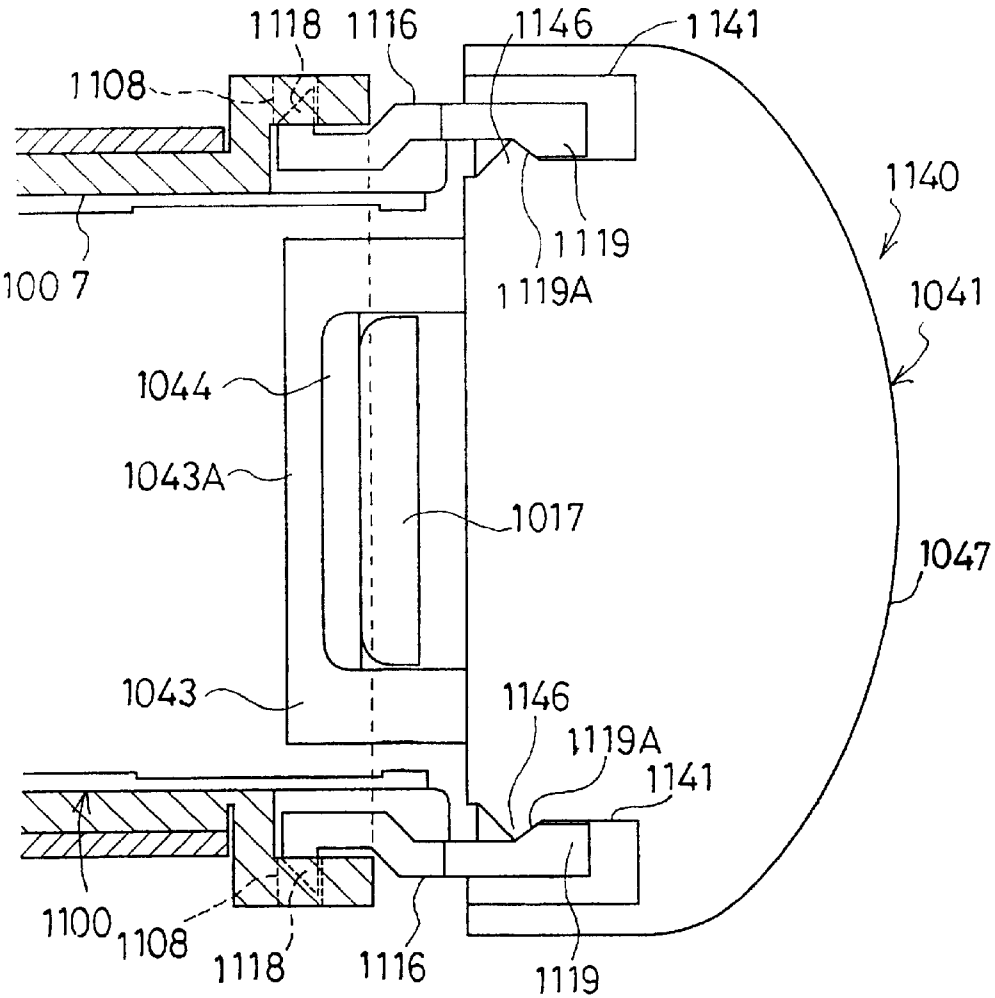
FIG. 38 is an explanatory diagram illustrating a third embodiment of the present invention.
Figure 39:
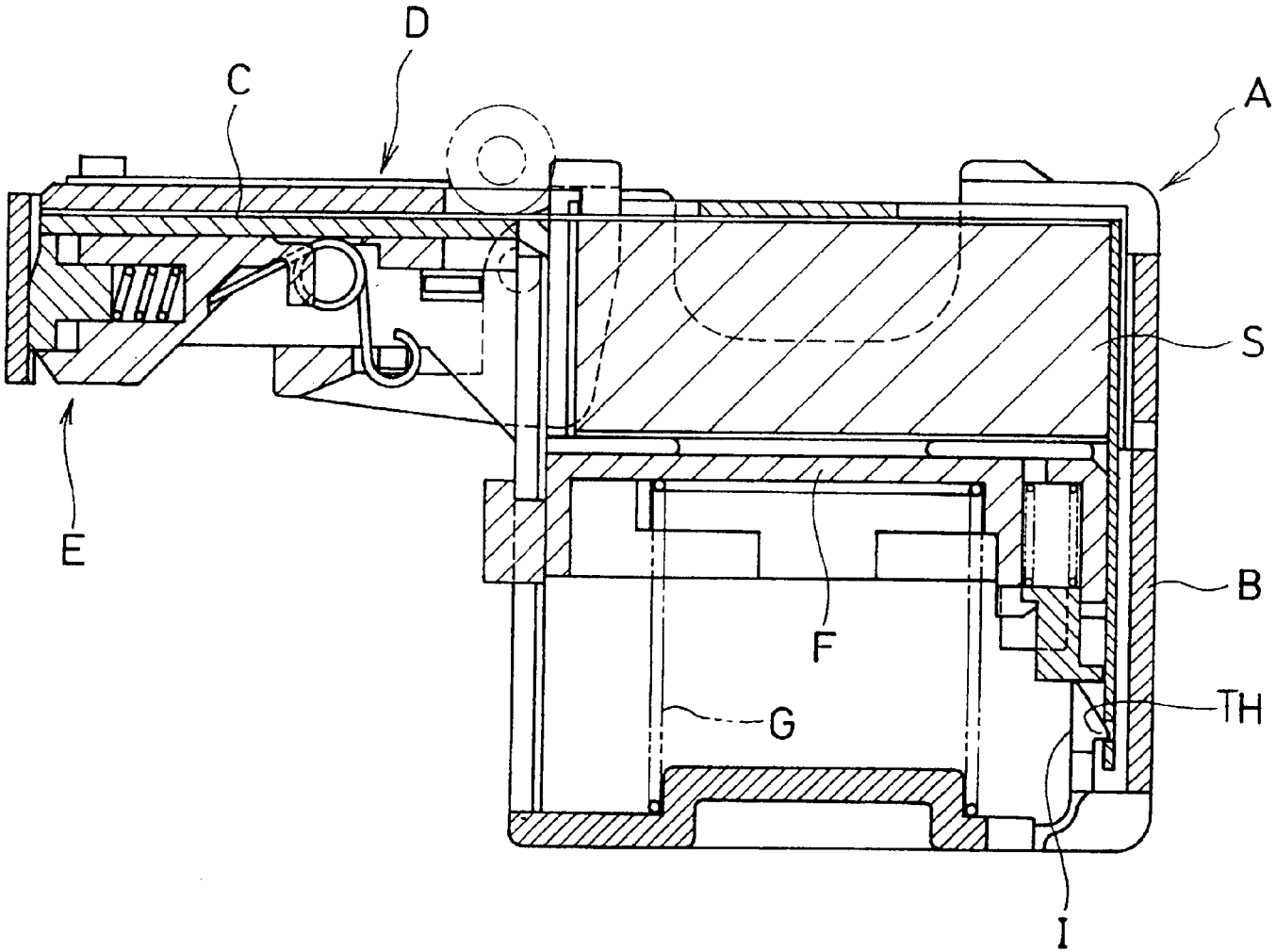
FIG. 39 is a sectional view showing a conventional cartridge for a motor-operated stapler.

FIG. 38 illustrates a cartridge 1100 according to a third embodiment of the resent invention. In the same figure, indicated at 1116 are arms. At front end portions of the arms 1116 are respectively formed a pair of retaining projections (retaining portions) 1118 projecting sideways, which projections 1118 are respectively engaged with a pair of retaining holes 1108 formed in the magazine 1007. Inwardly projecting portions (pushing portions) 1119 are formed respectively at rear portions of the arms 1116. The projecting portions 1119 are respectively formed with inclined surfaces 1119A which extend inwards to a greater extent toward the rear.

On the other hand, a knob 1140 is formed with a pair of recesses 1141 fr insertion therein of the rear portions of the as 1116. Side walls of the recesses 1141 are respectively formed with a pair of projections 1146 for pushing the projecting portions 1119 of the arms 1116. When the projections 1146 push the projecting portions 1119 of the arms 1116, the arms 1116 tilt in a direction opposite to the direction shown in FIG. 27 and the retaining projections 1118 are thereby disengaged from the retaining holes 1108.

Thus, by merely pulling out the knob 1140 backward, the retaining projections 1118 of the arms 1116 are disengaged from the retaining holes 1108 of the magazine 1007 to unlock the cartridge 1100, thereby permitting removal of the cartridge 1100.

What is claimed is:

1. A cartridge (600) for a motor-operated stapler (1), comprising a cartridge body (602), said cartridge body being removably loaded into a stapler body (10), said cartridge body having a receptacle chamber (603) for accommodating a stack of sheet staples (ST), and said cartridge body also having a delivery hole for sending out the sheet staples accommodated in said receptacle chamber, and a pressing means provided within said cartridge body, wherein said pressing means is constituted by a plate spring (520) for pressing a side of sending out means which sends out the sheet staples in said receptacle chamber to a side of said delivery hole.

2. A cartridge for a motor-operated stapler according to claim 1, further including a detent pawl (654) formed integrally with said plate spring for preventing a reverse movement of the sheet staples being delivered from said delivery hole.

3. A cartridge for a motor-operated stapler according to claim 1, wherein said plate spring is mounted to said cartridge body removably.

4. A cartridge for a motor-operated stapler according to claim 1, wherein said plate spring presses a bottom side of said receptacle chamber.

5. A cartridge for a motor-operated stapler comprising a cartridge body (602), said cartridge body being removably loaded into a stapler body (10), said cartridge body having a receptacle chamber (603) for accommodating a stack of sheet staples (ST), said cartridge body also having a delivery hole for sending out the sheet staples accommodated in said receptacle chamber, and said cartridge body further comprising longitudinally extending arms formed sideways of a rear portion (675) of said cartridge body, wherein retaining portions formed at front end portions of said arms being adapted to be respectively engaged with receptacle portion-side retaining portions formed in a cartridge receptacle portion of said stapler body, and pressing portions formed at rear portions of said arms are adapted to disengage said retaining portions of the arms from said receptacle portion-side retaining portions, and by pressing action on said pressing portions said retaining portions of the arms are released from engaged state, allowing said cartridge body to be pulled out backward and removed from said stapler body; and a knob (1040) capable of moving longitudinally by only a predetermined distance, said knob being attached to the rear portion of said cartridge body to provide further disengagement of said retaining portions of the arms by moving said knob backward and pressing on said pressing portions of said arms, so that said cartridge body can be pulled out backward from said stapler body.

6. A cartridge for a motor-operated stapler according to claim 5, wherein said knob is provided with projecting portions for pressing said pressing portions upon backward movement of the knob and is also provided with engaging portions adapted to engage the retaining portions formed in said cartridge body and pull out the cartridge body backward.

7. A cartridge for motor-operated stapler according to claim 5, wherein when said cartridge body is loaded into said stapler body and said knob is moved forward, the retaining portions of said arms are locked in the engaged state with said receptacle portion-side retaining portions formed in the cartridge body.

* * * * *

UNITED STATES PATENT AND TRADEMARK OFFICE

CERTIFICATE OF CORRECTION

PATENT NO. : 6,543,667 B2
DATED : April 8, 2003
INVENTOR(S) : Yoshie et al.

It is certified that error appears in the above-identified patent and that said Letters Patent is hereby corrected as shown below:

Title page,
Item [22], replace "Filed: Dec. 29, 2000" with -- Filed: Dec. 28, 2000 --

Signed and Sealed this

Sixteenth Day of September, 2003

JAMES E. ROGAN
*Director of the United States Patent and Trademark Office*